United States Patent [19]

Kadogawa et al.

[11] Patent Number: 4,691,398

[45] Date of Patent: Sep. 8, 1987

[54] SHOE MAKING MACHINE

[75] Inventors: Kouji Kadogawa, Funabashi; Tsunenori Watanabe, Asaka, both of Japan

[73] Assignee: Leader Company Limited, Tokyo, Japan

[21] Appl. No.: 652,654

[22] Filed: Sep. 20, 1984

[30] Foreign Application Priority Data

| | | | |
|---|---|---|---|
| Sep. 22, 1983 | [JP] | Japan | 58-174065 |
| Sep. 22, 1983 | [JP] | Japan | 58-175238 |
| Sep. 22, 1983 | [JP] | Japan | 58-175239 |
| Sep. 22, 1983 | [JP] | Japan | 58-175240 |
| Sep. 26, 1983 | [JP] | Japan | 58-177670 |

[51] Int. Cl.[4] ..... A43D 95/16; A43D 95/08; C14B 1/44

[52] U.S. Cl. ..... 12/77; 12/70; 12/78; 69/6.5

[58] Field of Search ..... 69/6.5; 12/70, 70.5, 12/77, 78, 85, 85.1, 85.3, 52.5, 17.2

[56] References Cited

U.S. PATENT DOCUMENTS

| | | | |
|---|---|---|---|
| 3,932,907 | 1/1976 | Vornberger | 12/77 |
| 3,975,932 | 8/1976 | Vornberger | 12/77 |
| 4,126,020 | 11/1978 | Tutt et al. | 12/77 |
| 4,134,278 | 1/1979 | Becka | 12/77 |
| 4,324,118 | 4/1982 | Bruggi | 69/6.5 |
| 4,331,011 | 5/1982 | Elliot et al. | 69/6.5 |
| 4,416,031 | 11/1983 | Shutt et al. | 69/6.5 |
| 4,555,823 | 12/1985 | Pedretti et al. | 12/77 |
| 4,561,139 | 12/1985 | Becka et al. | 69/6.5 |

*Primary Examiner*—Werner H. Schroeder
*Assistant Examiner*—Steven N. Meyers
*Attorney, Agent, or Firm*—Shlesinger, Arkwright, Garvey & Fado

[57] ABSTRACT

A shoe making machine is disclosed. It comprises a base; a slide table movably mounted on the base; a supporting member fixedly mounted on the slide table and having a clamping device for clamping the heel portion of a shoe body; a pair of guide shafts bridged in parallel each other above the slide table; a tiptoe portion carrying member having the tiptoe accommodating member mounted on its top and a pair of guide members connected to its lower end; locking device for locking and unlocking the tiptoe portion carrying member relative to the slide table, a processing tool table for processing the under-surface of the shoe body and having a constant original position to return slightly away from the tiptoe portion in the set state; and a device for controlling the movement of the tool table in the back and forth direction and up and down direction and of the slide table carrying the shoe body in the right and left direction. A shoe making machine including a detector for detecting a right or left shoe is also disclosed.

5 Claims, 37 Drawing Figures

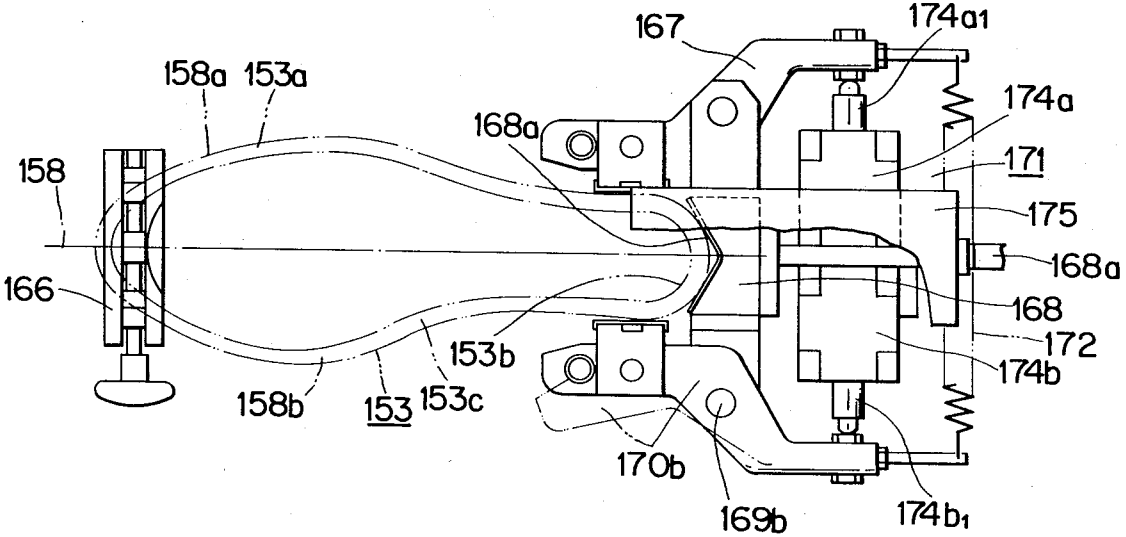
FIG. 29
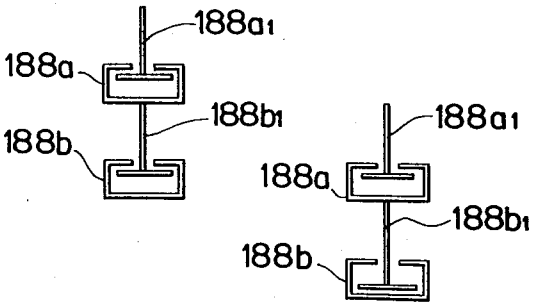
FIG. 32a
FIG. 32b
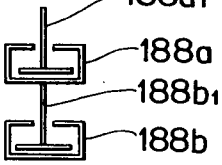
FIG. 32c

SHOE MAKING MACHINE

BACKGROUND OF THE INVENTION

This invention relates to a shoe making machine and more particularly to a device relating to the raising or gluing operation with respect to the marginal portion of the undersurface of a shoe body.

When a leather shoe is made, a raising operation as well as a gluing operation are required in order to properly affix the shoe body comprising an instep portion, a heel portion, and a tiptoe portion, i.e., the upper portion of a shoe to the bottom of a shoe, i.e., the lowest portion of a shoe. The raising operation is done on the marginal portion of the under-surface of the shoe body.

Now, in order to carry out said raising operation satisfactorily, firstly, the shoe body must be held or set properly; secondly, a shoe body setting equipment and a raising or gluing equipment must be controlled properly with respect to each other; thirdly, a shoe body must be determined promptly whether it is for the right or the left; and lastly, a consideration must be paid for the processing tool or the brush because it is easily deformed. Also, intimacy of the brush with respect to the surface to be processed or raised is very important.

A conventional shoe making machine, particularly the one relating to the shoe body setting equipment includes a stationary supporting member clamping and holding the heel portion of a shoe body; a movable tiptoe portion receiving member having its original position to return in a position slightly away from the tiptoe of a standard shoe body of the largest size; and a movable head having a raising brush or a gluing brush and having its original portion to return in a position slightly away from said receiving member, all being arranged on a stage.

In raising or gluing operation, the heel portion is clamped and held by the stationary supporting member first. Then, the tiptoe portion supporting member having a sensor such as a limit switch is moved to support the tiptoe of the shoe body, thereby setting the shoe body by means of said two members.

Thereafter the raising or gluing head is moved in order to carry out the raising or gluing operation.

Consequently, the receiving member as well as the raising head in the original position to return are required to be moved for different distances respectively until they reach the tiptoe portion depending on sizes of a shoe body to be processed. Particularly, in an equipment such as a shoe setting equipment wherein the starting time of movement of the raising or gluing head is the time for starting the raising or gluing operation, the different distance which the raising or gluing head is required to travel for, depending on sizes of the shoe body result in losses of operation time as well as deterioration of operation efficiency.

Another conventional shoe making machine, particularly the one relating to a device for properly controlling a shoe body setting equipment with respect to the raising or gluing equipment can be roughly classified in two types; one is the type to control the raising or gluing equipment by means of copying the outer marginal portion of the undersurface of a model of the shoe body to be processed, while the other is the type for controlling the raising or gluing equipment by travelling directly along the outer marginal portion of the shoe body to be processed. The former has such disadvantage as that the equipment becomes large in size since a model for the shoe body to be processed is required, while the latter has such disadvantages as that a comparatively large number of parts are required since many sensors are employed for detecting the configuration of the outer marginal portion, that its control is complicated, that a high degree of accuracy is unobtainable and that costs beccme comparatively high.

Other conventional shoe making machines which particularly relates to devices to raise the outer marginal portion of the under-surface of a shoe body are shown as typical examples in FIGS. 12 and 13.

In FIG. 12, a stationary shoe body a is set on a table. Two brushes 6, 6 are moved in the longitudinal direction of the shoe body a for brushing and raising the inside and the outside of the under-surface outer marginal portion c by means of electrically or mechanically detecting the external configuration of a model formed generally in the same configuration in its plan view to the bottom member (not shown) of the shoe body a.

In the above conventional equipment, in order to grind or brush the under-surface outer marginal portion c of, e.g., one of the pair of right and left shoe bodies a, a, two brushes having different revolving direction with respect to each other are moved in the longitudinal direction for grinding or brushing. Consequently, it has such disadvantages as that the raising of the two brushes 6, 6 are deformed due to one directional revolving. Furthermore, since it requires two brushes 6, 6 and two motors for driving the brushes, the structure thereof is complicated and two many parts are involved, thus resulting in high costs. In addition, there exists such technical problem as to control the revolving speeds of the two motors, respectively. Furthermore, since the under-surface outer marginal portion c of the shoe body a is unevenly formed in a horizontal plane; e.g., the arch portion d is of concave while the heel portion e and outside portion are of convex. Because of the foregoing, when the under-surface outer marginal portion c of the shoe body a is ground or brushed by using the conventional abrasive equipment, it occurs that the brushes 6, 6 contact the under-surface outer marginal portion c of the shoe body a too hard, or too weak, or otherwise a floating state of the brush is created. As a result, the under-surface outer marginal portion c is torn up, or otherwise there remains a portion left unbrushed. That is, the conventional equipment has such disadvantage as that the brushed portion lacks uniformity in its finish and that the yield of the product is poor.

SUMMARY OF THE INVENTION

The present invention is accomplished in view of the above.

It is therefore an object of the present invention to provide a shoe making machine, wherein a heel supporting member is moved first for a suitable distance depending on sizes of a shoe body to be processed toward a raising or gluing head which is in the original returning position for setting the shoe body by said supporting member and the tiptoe receiving member, so that the distance from the tiptoe of the shoe body to the raising or gluing equipment which is in the original returning position is always kept to be constant irrespective of the shoe size.

It is another object of the invention to provide a shoe making machine which can improve operative efficiency by eliminating losses of operation time.

It is another important object of the present inventicn to provide a shoe making machine, wherein the moving direction of the raising or gluing brush is set to be X and Z axes, while the moving direction of the shoe body setting table is set to be a Y axis, and the above-mentioned axes are driven by pulse motors controlled respectively by operation command of a computer which memorizes processing data of one standard size of a shoe recorded in a cassette tape in such a manner as to move displacement of X and Z axes of the raising or gluing brush following the configuration of the under-surface outer marginal portion of a shoe which changes kaleidoscopically in accordance with the movement (displacement of Y axis) of the shoe body setting table.

A further object of the present invention is to provide a shoe making machine, wherein the shoe body to be processed can be easily detected whether it is for the right or left side only by clamping one side of a pair of shoe bodies on a same table.

Still a further object of the present invention is to provide a shoe making machine, wherein a driving motor is driven normally or reversely at a predetermined position to actuate a processing tool based on one processing data for controlling the revolving speed of the motor without using a model as a copy.

An additional object of the invention is to provide a shoe making machine, wherein deformation of the raising of a brush serving as a processing tool can be effectively prevented, and abrasive operation as well as application of an adhesive agent with respect to the under-surface of the shoe body can be carried out promptly.

An even further important object of the present invention is to provide a shoe making machine, wherein a processing tool such as a brush is arranged swingable in its width direction according to the uneven configuration of the under-surface outer marginal portion of the shoe body, so that the processing tool can be normally kept contacted therewith and the under-surface of the outer marginal portion of the shoe can be brushed evenly and without leaving a portion left unbrushed.

To achieve the above mentioned objects and others, there is essentially provided a shoe making machine comprising a base; a slide table movable mounted on said base; a supporting member fixedly mounted on said slide table and having means for clamping the heel portion of a shoe body to be processed; a pair of guide shafts bridged in parallel relation with respect to each other above said slide table; a tiptoe portion carrying member having a tiptoe accommodating member mounted on the top thereof and a pair of guide members connected to the lower end thereof, said guide shafts being loosely fitted into said guide members respectively; locking means for locking and unlocking said tiptoe portion carrying member with respect to said slide table; a processing tool head table including a processing tool for the outer marginal portion of the under-surface of the shoe body having a constant original position to return slightly away from the tiptoe portion of the shoe body in the set state; and means for controlling the movement of the back and forth as well as up and down directions of said processing tool head table and the movement of the right and left direction of said slide table carrying the shoe body simultaneosuly, so that a shoe body of any sizes can be promptly processed in accordance with an operation command of a computer which memorizes data of shoe sizes.

There is also essentially provided a shoe making machine comprising a detector for detecting right and left shoe shape including a pair of clamping arms of the heel portion of a shoe body, means for actuating the arms on a table and a sensor detecting displacement of the motion amount of said clamping arms; means for changing the revolving direction of a processing tool at the central bisector of a shoe body as a boarder line; and means for normally contacting the processing tool flatly on the uneven under-surface outer marginal portion of the shoe body.

BRIEF DESCRIPTION OF THE DRAWINGS

FIGS. 23*a* through 23*c* are sectional views showing the operating states of a twin pneumatic cylinder, wherein FIG. 23*a* is a sectional view of the twin pneumatic cylinder in its neutral position where only the cylinder rod of the upper pneumatic cylinder is extended, FIG. 23*b* is a sectional view showing the cylinder rod of the both upper and lower pneumatic cylinders are extended, and FIG. 23*c* is a sectional view showing the cylinder rods of the both upper and lower pneumatic cylinders are contracted;

FIG. 29 is likewise a plan view showing one example of a clamp mechanism to be used for the shoe making machine of FIG. 25;

FIGS. 32*a* through 32*c* are sectional views each schematically showing the operation state of a twin pneumatic cylinder served as a driving mechanism for determining the height of mounting positions of an abrasive unit to be used for the shoe making machine of FIG. 25.

DETAILED DESCRIPTION OF THE EMBODIMENTS

Figure 1:
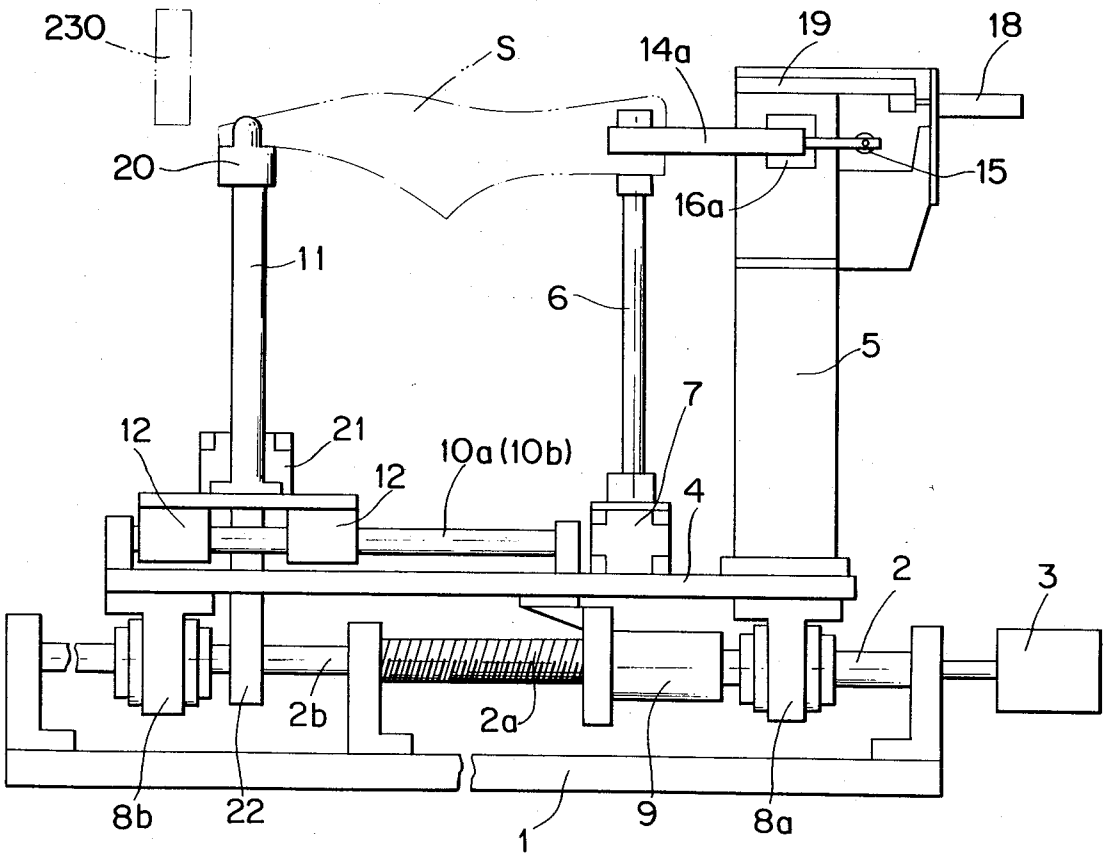
FIG. 1 is a front view of an embodiment of a shoe setting equipment to be used for a shoe making machine according to the present invention.

Referring first to FIGS. 1 through 4, one preferred embodiment of a shoe setting equipment to be used for a shoe making machine according to the present invention will be described.

1 denotes a base on which the bearings are fixedly mounted for carrying a rotary shaft 2 stretched therebetween and driven by a pulse motor 3. Said shaft 2 is provided with as a part thereof a rotary threaded shaft 2*a* having a threaded outer periphery. A fixed shaft 2*b* is stretched between and carried by another bearings mounted on the base 1.

4 denotes a slide table on which fixedly mounted are a supporting member 5 having a clamping and holding mechanism of a shoe heel portion and a driving cylinder 7 for driving a lifting rod 6 in order to move the heel portion into a predetermined position. Said slide table 4 is provided with supporting members 8*a*, 8*b* which are slidingly movable along said rotary shaft 2 as well as said fixed shaft 2*b*. Said slide table 4 is also provided with a movable supporting member 9 which is fitted with the rotary shaft portion 2*a*. The slide table 4 is moved reciprocally by means of the rotation of the shaft portion 2*a*.

10*a*, 10*b* denote a pair of guide shafts (only 10*a* is shown) disposed in parallel relation with respect to each other above the slide table 4. Said guide shaft 10*a* is loosely fitted into a pair of guide members 12 which are mounted on a tiptoe portion carrying member 11.

Figure 2:
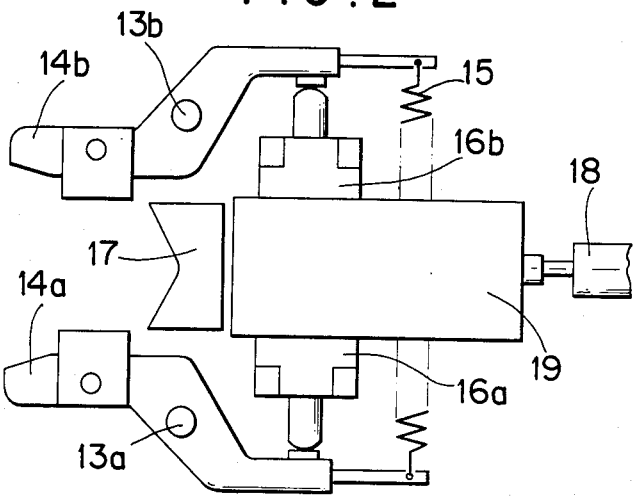
FIG. 2 is a plan view of a clamping mechanism of the heel portion.

As shown in FIG. 2, the clamping and holding mechanism of the shoe heel portion mounted on the supporting member 5 comprises a pair of arms 14*a*, 14*b* pivotally supported by shafts 13*a*, 13*b*; a spring 15 stretched between the rear ends of the arms 14*a*, 14*b*; a pair of cylinders 16*a*, 16*b* provided between the spring 15 and the shafts 13*a*, 13*b* and adapted to actuate the tip portions of the arms 14*a*, 14*b* in such a manner as to clamp the both side faces of the heel portion; a cushion plate 17 for abutting against the rear end outer periphery of the shoe heel portion; and a regulating plate 19 which moves reciprocally according to the operation of a cylinder 18 and cooperates with the lifting rod 6 for regulating the position of the shoe heel portion.

Figure 3:
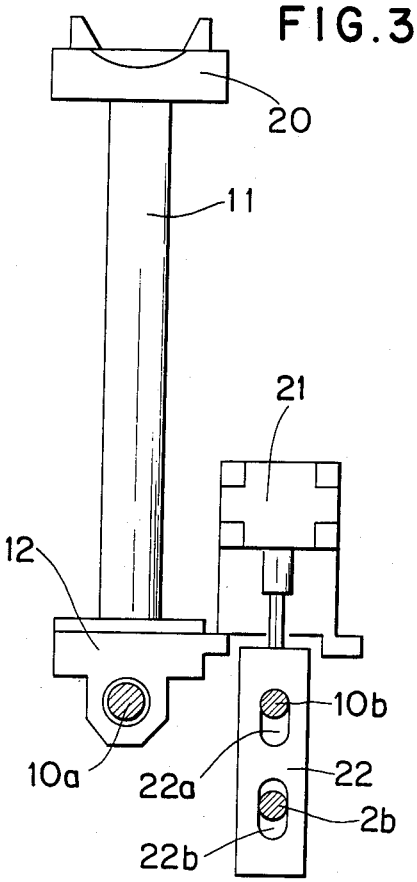
FIG. 3 is a side view of a tiptoe portion carrying member.

Likewise, the tiptoe portion carrying member 11 comprises, as shown in FIG. 3, a tiptoe accommodating member 20 mounted on the upper end thereof; a pair of guide members 12 mounted on the lower end thereof and adapted to slide a cylinder 21 and the guide shaft 10*a*; and a lock plate 22 connected with the rod of the cylinder 21 and formed with elongated slots 22*a*, 22*b* for permitting the guide shaft 10*a* and the fixed shaft 2*b* to penetrate therethrough.

In FIG. 1, 230 denotes a raising or gluing brush which is in an original position to return or original returning position.

Figure 4A:
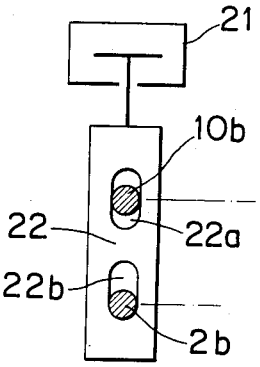
FIG. 4*a* and FIG. 4*b* are schematic view showing the operation of a lock plate.
Figure 4B:
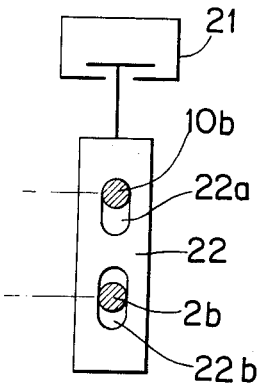
Figure 9:
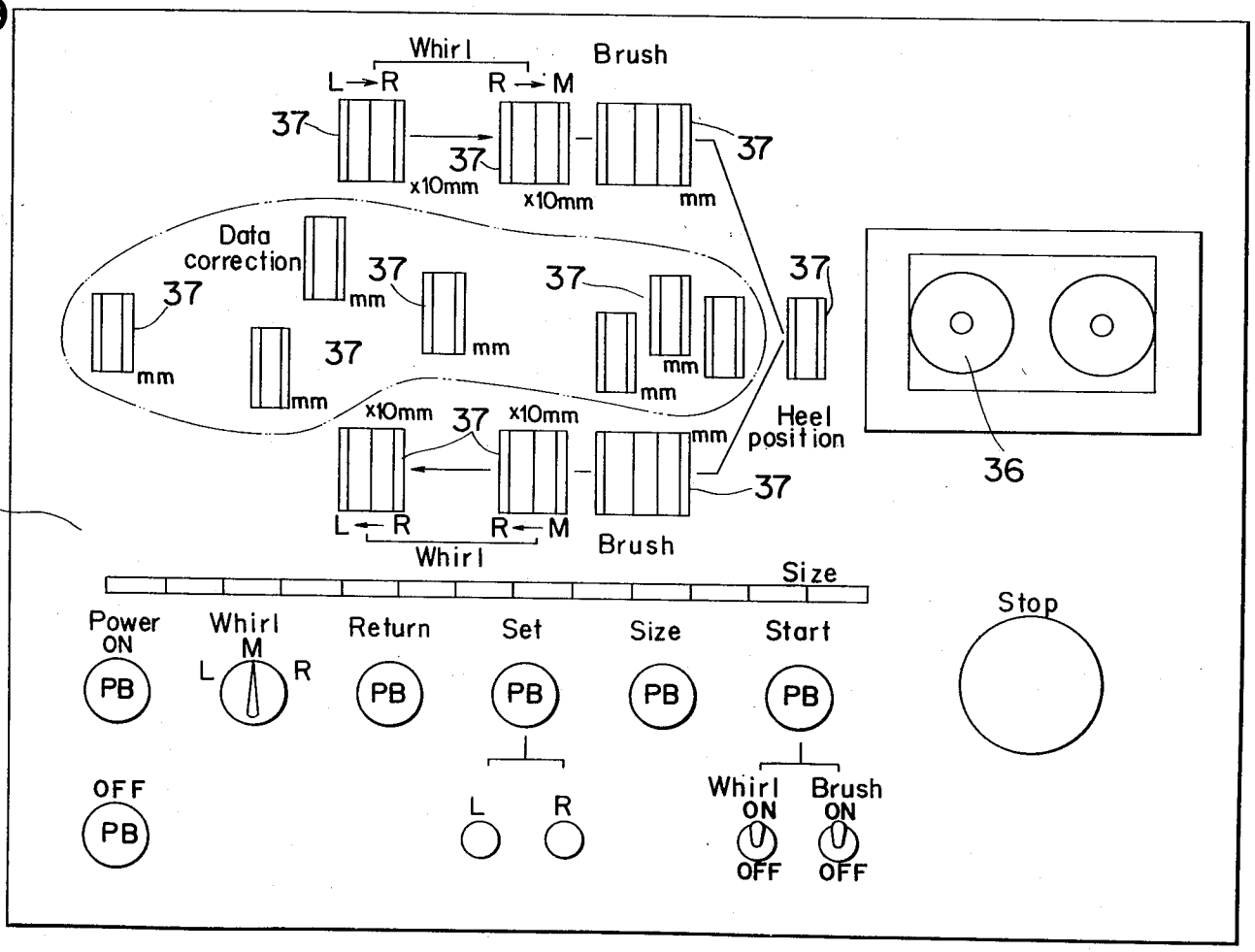
FIG. 9 is a front view of a control panel.
Figure 18:
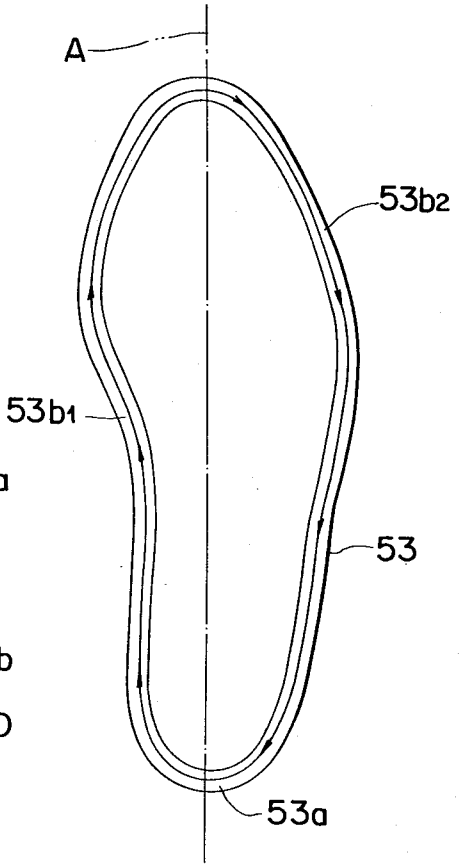
FIG. 18 is likewise a plan view of the under-surface of a shoe body schematically showing the sequence of the abrasive operation.

Nextly, the function of the above will be described. When a "return" button on a control panel shown in FIG. 9 is pressed while the tiptoe portion carrying member 11 is in the original returning position, the cylinder 21 is actuated to lift up the lock plate 22 as shown in FIG. 4*a* so that the guide shaft 10*b* is positioned in the central portion of the slot 22*a* defined in the plate 22. Simultaneously, the lower end of the slot 22*b* is mated with the fixed shaft 2*b*. As a result, the tiptoe portion carrying member 11 is locked with respect to the lock plate 22, while the guide shafts 10*a*, 10*b* are kept in such a state as to be permitted to move through the guide member 12 and along the elongated slot 22*a* of the lock plate 22, respectively. In other words, the slide table 4 is in a movable state.

When a "size" button on the control panel is pressed depending on sizes of a shoe to be processed, a driving pulse of the pulse motor 3 which matches the shoe size to be processed is commanded in accordance with the operation of a computer (CPU) which memorizes processing data of a shoe recorded in a cassette tape built in the control panel.

As the pulse motor 3 is driven, the rotary shaft 2 is rotated. In accordance with the movement of the movable supporting member 9 fitted with the rotary threaded shaft portion 2*a*, the slide table 4 is moved toward the right direction or the left direction relative to the present position shown in FIG. 1, so that the heel portion supporting member 5 is moved into a predetermined position.

Then, the tiptoe of the shoe body is placed in the accommodating member 20 mounted on the tiptoe portion carrying member 11, the rear end outer periphery of the heel portion is abutted against the cushion plate 17 of the supporting member 5. The heel portion of the shoe body S is placed on the lifting rod 6.

When a "set" button on the control panel is pressed, the cylinder 18 is actuated to progress the regulating plate 19 above the upper face of the heel portion. Subsequently, the cylinder 7 is actuated to lift up the lifting rod 6 until the heel portion abuts against the regulating plate 19 to determine the right position of the tiptoe portion in the accommodating member 20 and the heel portion, i.e., the position of a shoe S shown in FIG. 1.

Thereafter, the cylinders 16*a*, 16*b* are operated to force the arms 14*a*, 14*b* to clamp and hold the both side faces of the heel portion against the force of the tension spring 15.

Then, the cylinder 18 is stopped operating, so that the regulating plate 19 is retreated.

Thereafter, the cylinder 21 is stopped operating, so that the lock plate 22 is lowered, the upper end of the slot 22*a* is mated with the guide shaft 10*b*, and the fixed shaft 2*b* is brought to be the central portion of the elongated slot 22*b*.

The foregoing is a setting operation applicable to shoes of various sizes which are to be processed. It should be noted that the cylinder 21 stops operating, because the subsequent process for raising and gluing operation can be carried out smoothly. That is, the cylinder 21 stops operating so that the lock plate 22 is locked with respect to the guide shaft 10*b* stretched over the slide table 4 and made free with respect to the fixed shaft 2*b*. By doing so, the slide shaft 4 of the present setting equipment can be moved right and left by the pulse motor 3 in order to cooperate with the movement of a raising or gluing brush head which starts moving from the right side to the left side on the under-surface of the instep portion of the shoe in such a manner as to start from the tiptoe portion through the heel portion and through contra-rotation of the brush and to the tiptoe portion in the raising or gluing process which will be started by pushing an actuating button on the control panel, thereby enabling to shorten the operating time.

Figure 5:
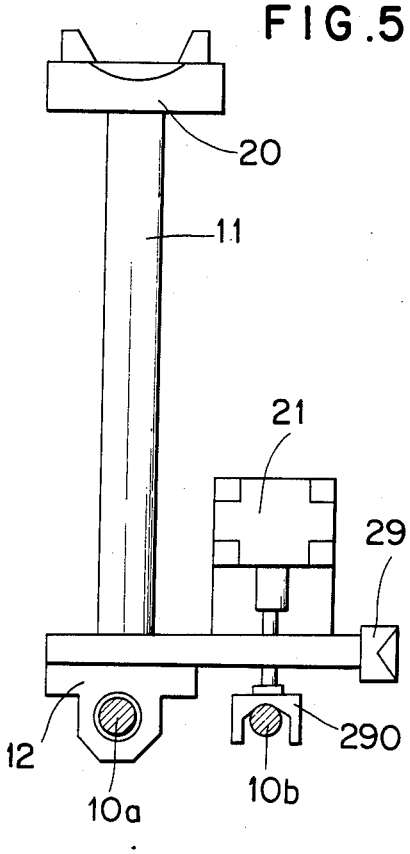
FIG. 5 is a side view showing a modified embodiment of FIG. 3.
Figure 12:
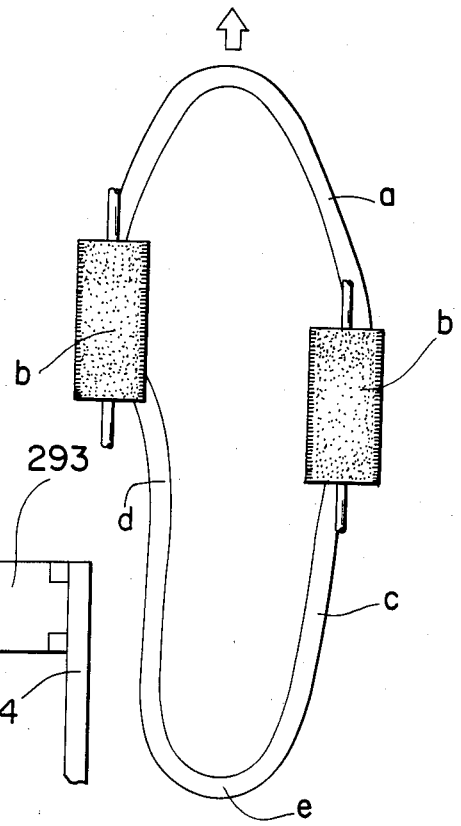
FIG. 12 and FIG. 13 are plan views showing two examples of conventional abrasive devices.

FIG. 5 illustrates a modified embodiment of the locking mechanism of the lock plate 22 of the former embodiment. In this modified embodiment, locking and unlocking of the locking plate 22 with respect to the fixed shaft 2*b* in the former embodiment is carried out by means of a clutch mechanism provided between the base 1 and the tiptoe portion carrying member 11.

The rod of the cylinder 21 is provided with a lock plate 290 which is engaged with or disengaged from the guide shaft 10*b*. The tiptoe portion carrying member 11 is provided with a pin receiving member 291. A cylinder 293 moving a stopper pin 292 is mounted on a supporting member 294 mounted on the base 1, said pin 292 being engaged with or disengaged from the pin receiving member 291. The cylinder 293 is provided in opposite relation with respect to the original position to return of the tiptoe portion carrying member 11.

The arrangement being such that when the shoe is set, the cylinder 21 is operated to lift up the lock plate 290 disengaging from the guide shaft 10. Simultaneously, the stopper pin 292 is fitted into and engaged with the pin receiving member 291 by means of the cylinder 293. As a result, the tiptoe carrying member 11 is locked with respect to the base 1 in the original position to return.

In this case, since the guide shafts 10*a*, 10*b* are kept free with respect to the guide member 12 and the lock plate 290, the slide table 4 is in a movable state.

Consequently, the slide table 4 is moved by the pulse motor 3 driven, the supporting member 5 for the heel portion is moved toward the tiptoe portion carrying member 11 until it reaches a position matching the size of a shoe to be processed.

After the setting of the shoe body is finished, the cylinders 21 and 293 are stopped operating and the member 11 is now movable together with the slide table 4, because the lock plate 290 engages with the guide shaft 10*b*. As a result, the tiptoe carrying member 11 is moved right and left with respect to the raising or gluing brush 230.

The effect of the present invention will now be descrited. According to the present invention, the heel portion supporting member is moved toward the tiptoe portion carrying member which is in the original position to return depending on the sizes of a shoe to be processed, and the distance from the raising or gluing head which is in the original position to return to the tiptoe portion is set to be constant. Consequently, losses of operating time for raising or gluing operation as seen in the prior art operation can be decreased and the operating efficiency can be significantly increased.

Furthermore, the tiptoe portion carrying member is kept in the locked state by the lock plate or the clutch mechanism when the heel portion supporting member is moved for matching the size of the shoe, but when the raising or gluing operation is started upon completion of the shoe setting operation, since the tiptoe carrying member cooperates with the movement of the raising or gluing head and moves together with the slide table, operating time can be shortened.

Referring to FIG. 1, FIG. 4 and FIGS. 6 through 10, a controlling equipment of a shoe setting table equipment as well as a raising or gluing brush table equipment which are to be used for the shoe making machine according to the present invention will be described.

Firstly, the outline of the raising or gluing brush table equipment will be described. A denotes a shoe setting table and B denotes a raising or gluing table. The raising or gluing table B is arranged to move right and left, or back and forth (X axis) and up and down (Z axis) perpendicular to the moving direction (Y axis) of the shoe setting table. The shoe setting table A is constituted in the following manner.

A rotary shaft 2 stretched between bearings mounted on a base 1 is driven by a pulse motor 3. A part of the rotary shaft 2 is provided with a rotary threaded shaft portion 2*a* having a threaded outer periphery. A fixed shaft 2*b* is stretched between another bearings mounted on the table 1.

4 denotes a slide table (Y axis movement) on which fixedly mounted are a supporting member 5 having a pair of arms 14*a*, 14*b* actuated by a pair of cylinders (only 14*a* and 16*a* are shown) to clamp and hold the shoe heel portion and a cylinder 7 for actuating a lift rod 6 to move the heel portion into a predetermined position. Said slide table 4 is provided with supporting members 8*a*, 8*b* which are slidingly movable along the rotary shaft 2 and the fixed shaft 2*b*. Said slide table 4 is also provided with a movable supporting member 9 which is fitted with the rotary threaded shaft portion 2*a* to move the slide table 4 reciprocally by means of the rotation of the shaft portion 2*a*.

A pair of guide shafts 10*a*, 10*b* (only 10*a* is shown) is stretched over the slide table 4. One of the guide shafts 10*a* is loosely fitted into a pair of guide members 12 mounted on a tiptoe carrying member 11.

15 denotes a tension spring stretched between the rear ends of the arms 14*a*, 14*b*. 17 denotes a cushion plate against which the outer periphery of the heel portion end outer periphery is abutted. 19 denotes a regulating plate which moves forward and backward according to the operation of the cylinder 18 and cooperates with the lifting rod 6 for regulating the position of the shoe heel portion.

Likewise, the tiptoe carrying member 11 comprises, as shown in FIG. 3, a tiptoe accommodating member 20 mounted on the upper end thereof; a pair of guide members 12 mounted on the lower end thereof and adapted to slide a cylinder 21 and the guide shaft 10*a* and a lock plate 22 connected with the rod of the cylinder 11 and formed with elongated slots 22*a*, 22*b* for permitting the guiding shaft 10*a* and the fixed shaft 2*b* to penetrate therethrough.

The raising or gluing brush head table B is constituted in the following manner.

Figure 8:
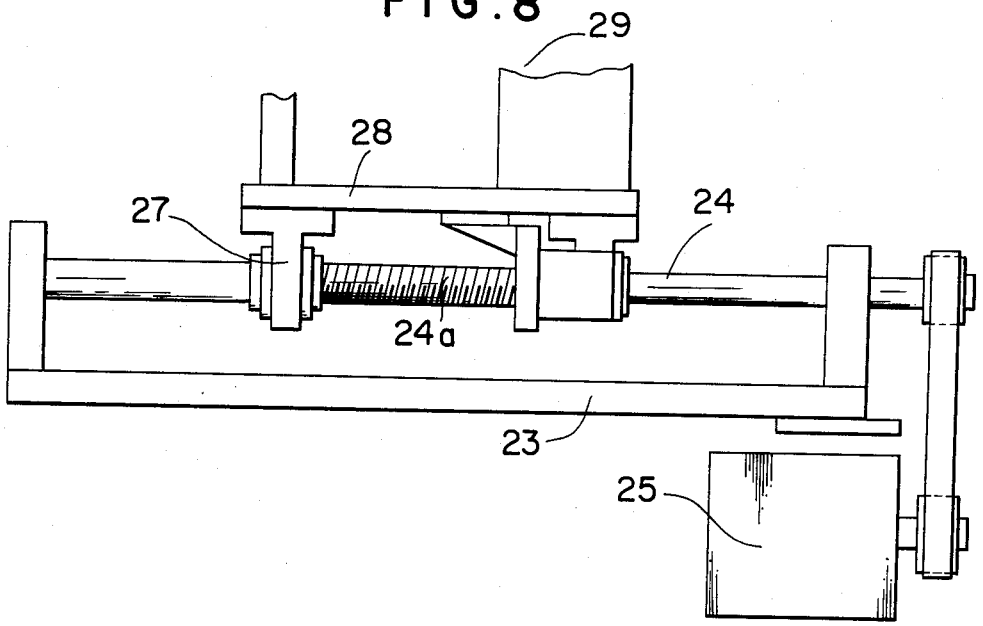
FIG. 8 is a side view of a raising or gluing brush head table.

The moving mechanism in the X direction is substantially the same as that of the slide table 4 of the shoe setting table A. As shown in FIG. 8, a rotary shaft 24 stretched over the bearings mounted on a base 23 is driven by a pulse motor 25 through a belt. A part of the rotary shaft portion 24 is provided with a rotary threaded shaft portion 24*a* having a threaded outer periphery. A slide table 28 is mounted both on a movable supporting member 26 fitted with the treated shaft portion 24*a* and on a supporting member 27 for sliding the rotary shaft 24.

Figure 7:
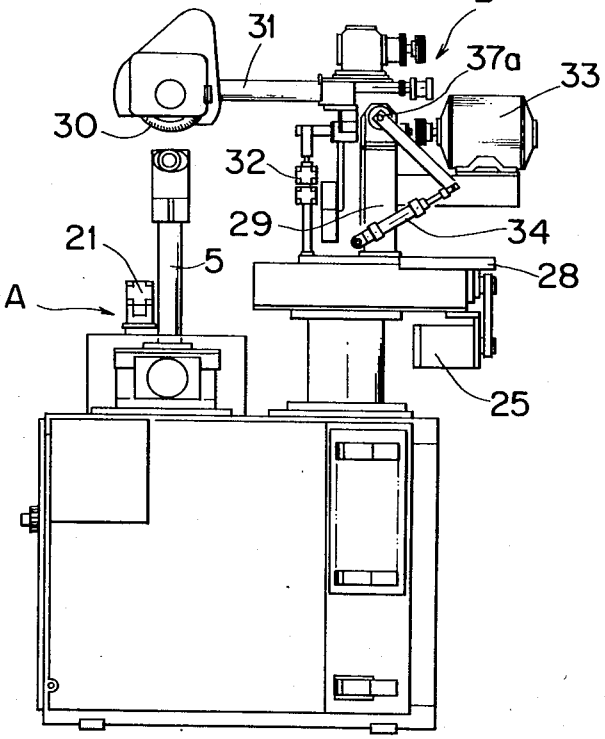
FIG. 7 is a side view of the above.

A brush head 29 for raising or gluing is mounted on said slide table 28 as shown in FIG. 7.

31 denotes a supporting arm for a brush 30 for raising or gluing and is swingable in the vertical direction (Z axis direction) with respect to the Y axis by a twin cylinder 32. The supporting arm 31 is also swingable in the back and forth direction with respect to the Y axis by another twin cylinder (not shown). 33 denotes an induction motor for driving the brush 30 through a belt, and 34 denotes a pressure regulating damper for the under-surface outer marginal portion of the shoe body.

The supporting arm 31 is swingable with respect to the Y axis as mentioned above, so that raising operation is carried out correctly by means of normally facing the brush 30 perpendicular with respect to the shoe under-surface.

Figure 10:
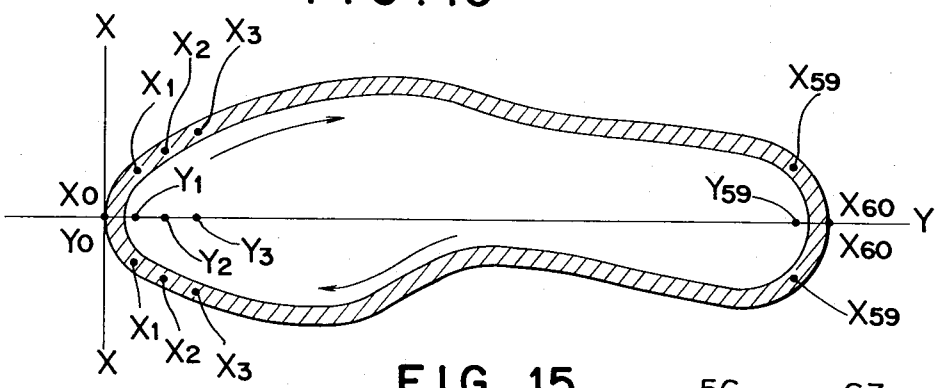
FIG. 10 is a schematic view showing control points on an under-surface of a shoe body.
Figure 15:
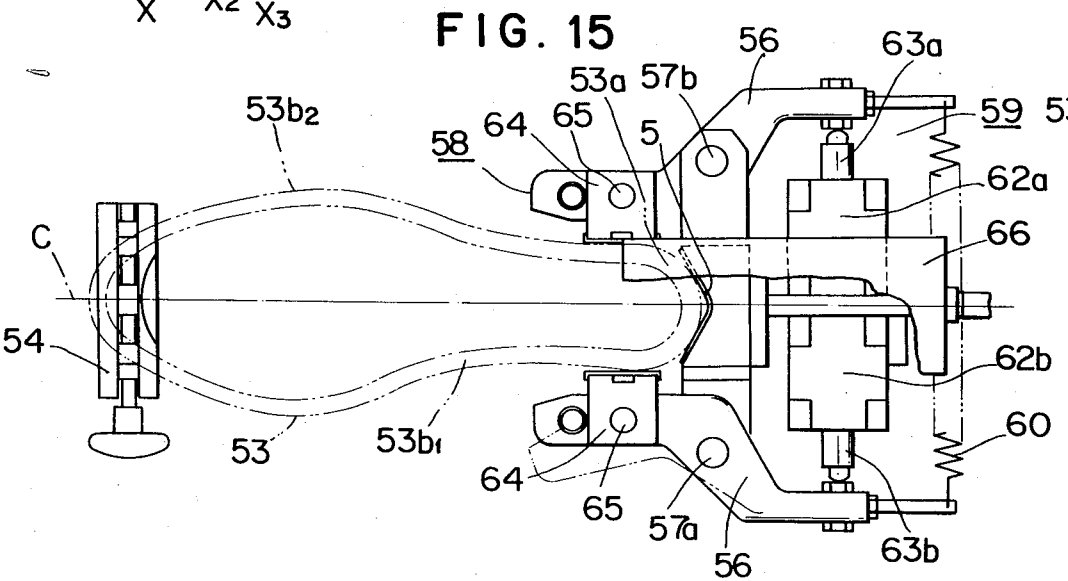
FIG. 15 is likewise a plan view partly broken of the above.
Figure 11:
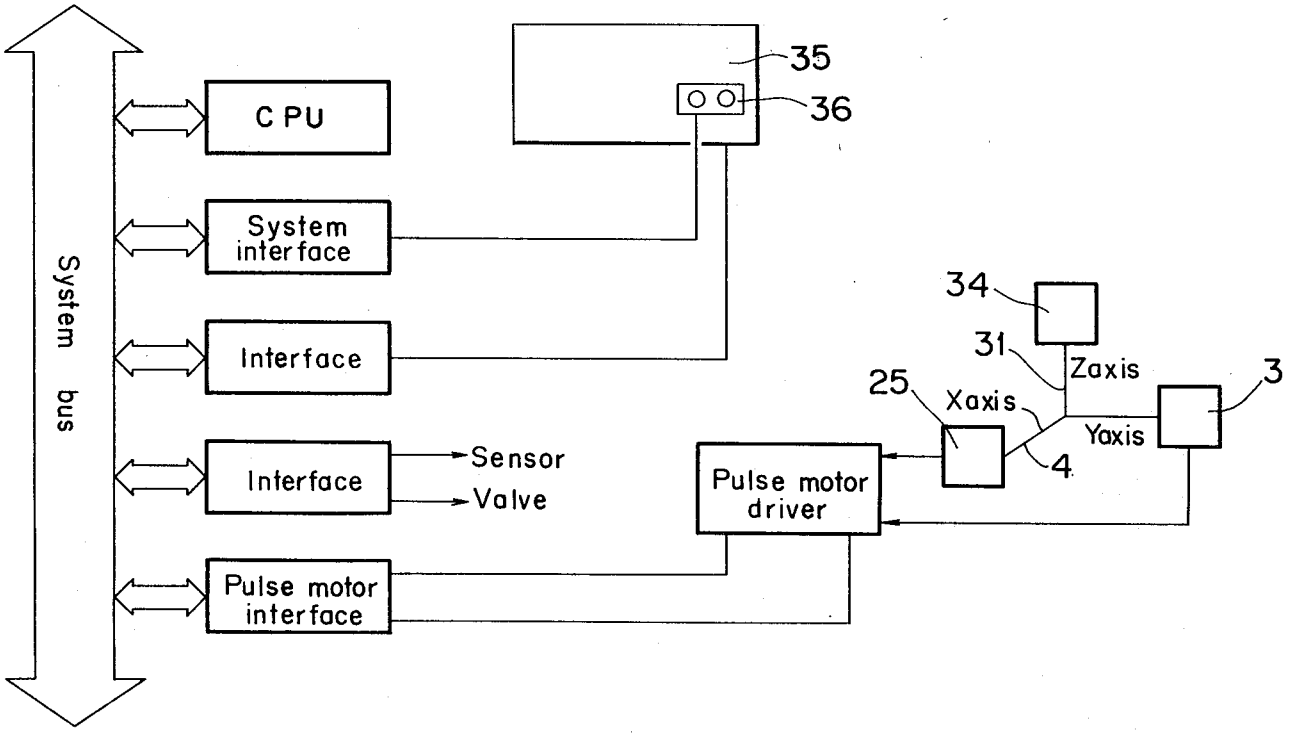
FIG. 11 is a view of a system block.
Figure 14:
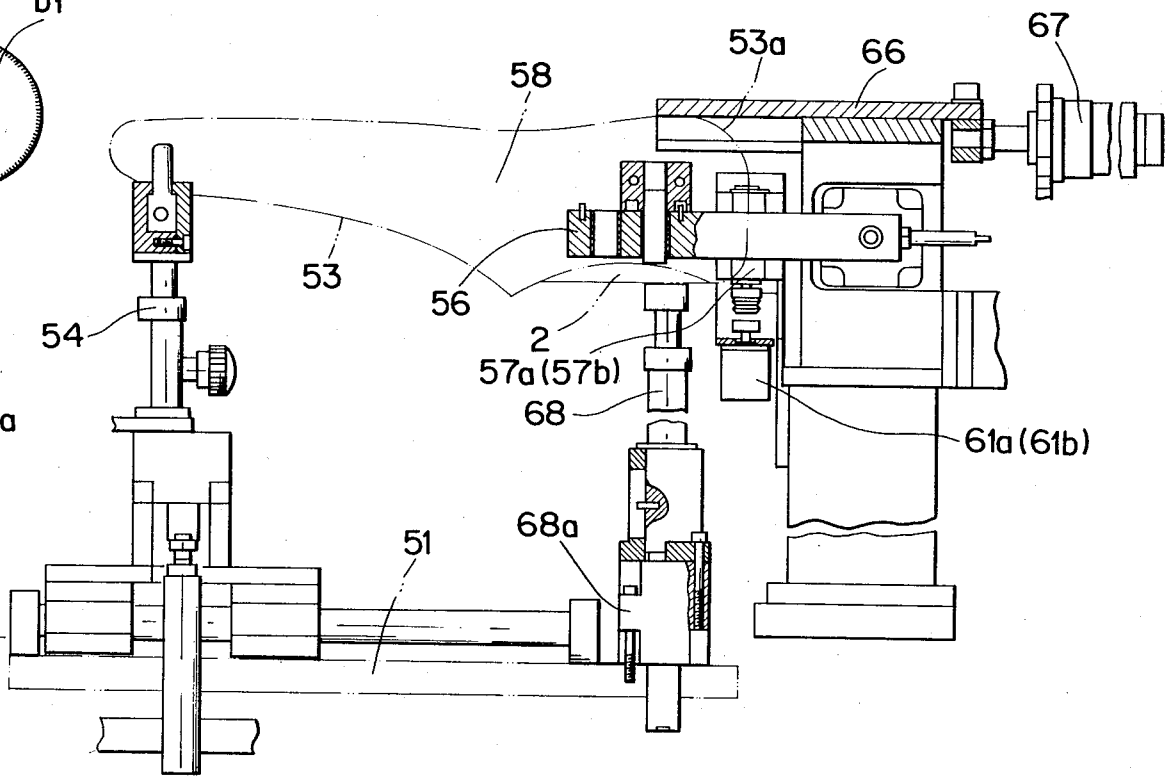
FIG. 14 is a front view partly broken showing a right and left detecting equipment to be used for a shoe making machine according to the present invention.
Figure 13:
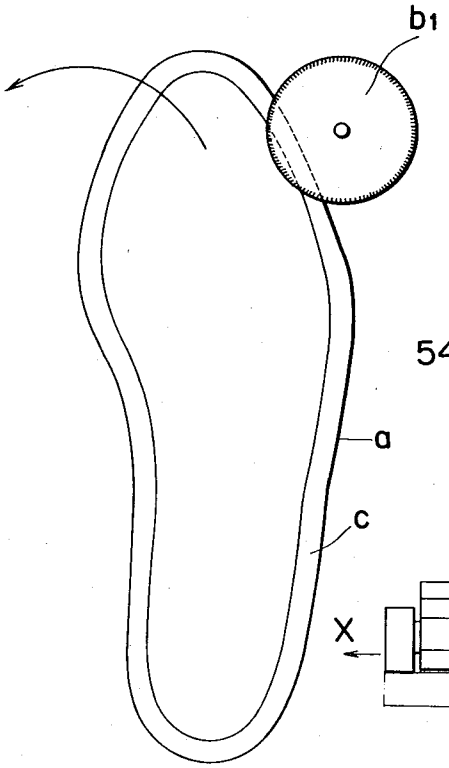
Figure 17:
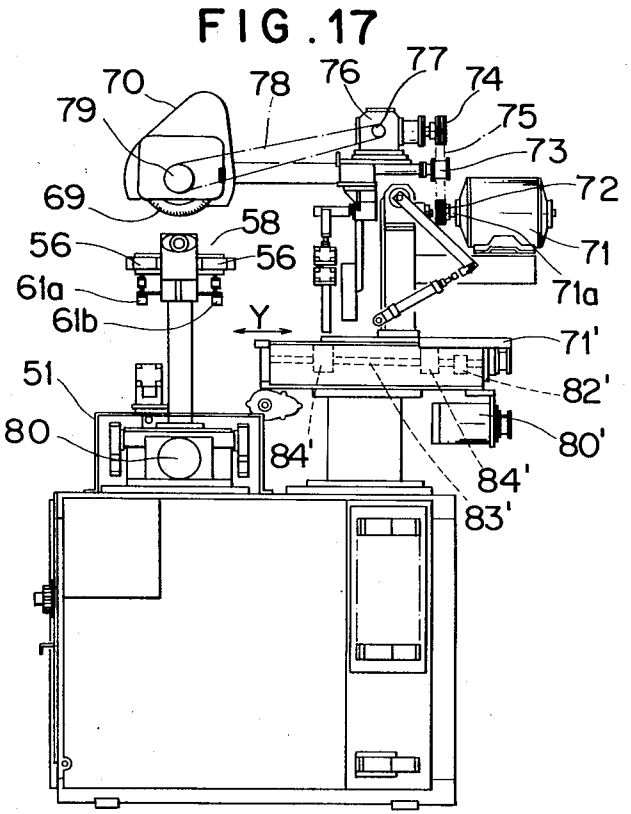
FIG. 17 is likewise a side view of the above.
Figure 16:
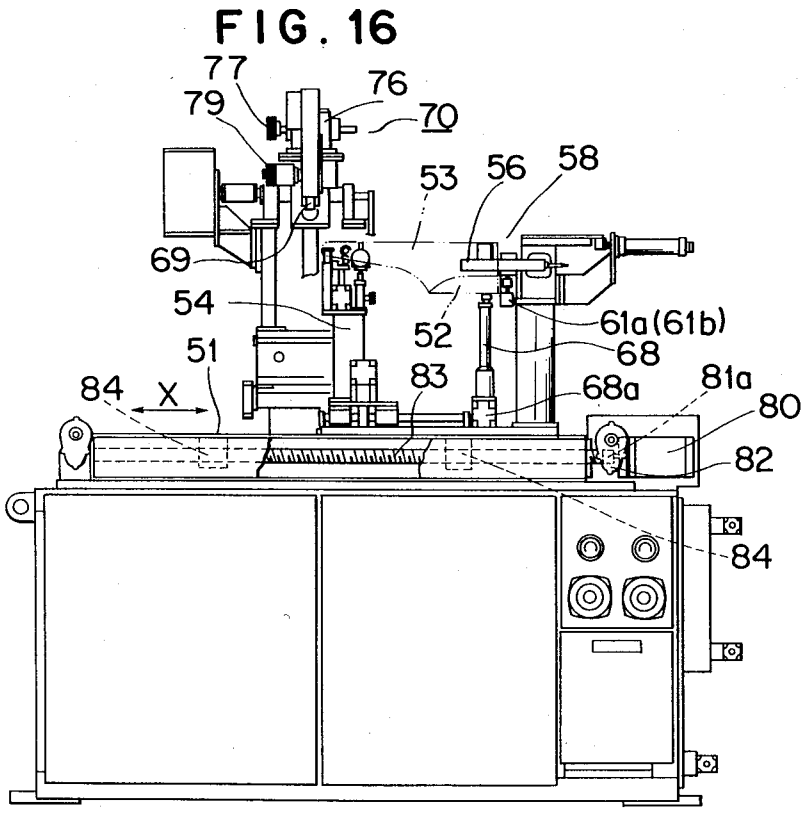
FIG. 16 is a front view of the shoe making machine with the right and left detecting equipment mounted.
Figure 19:
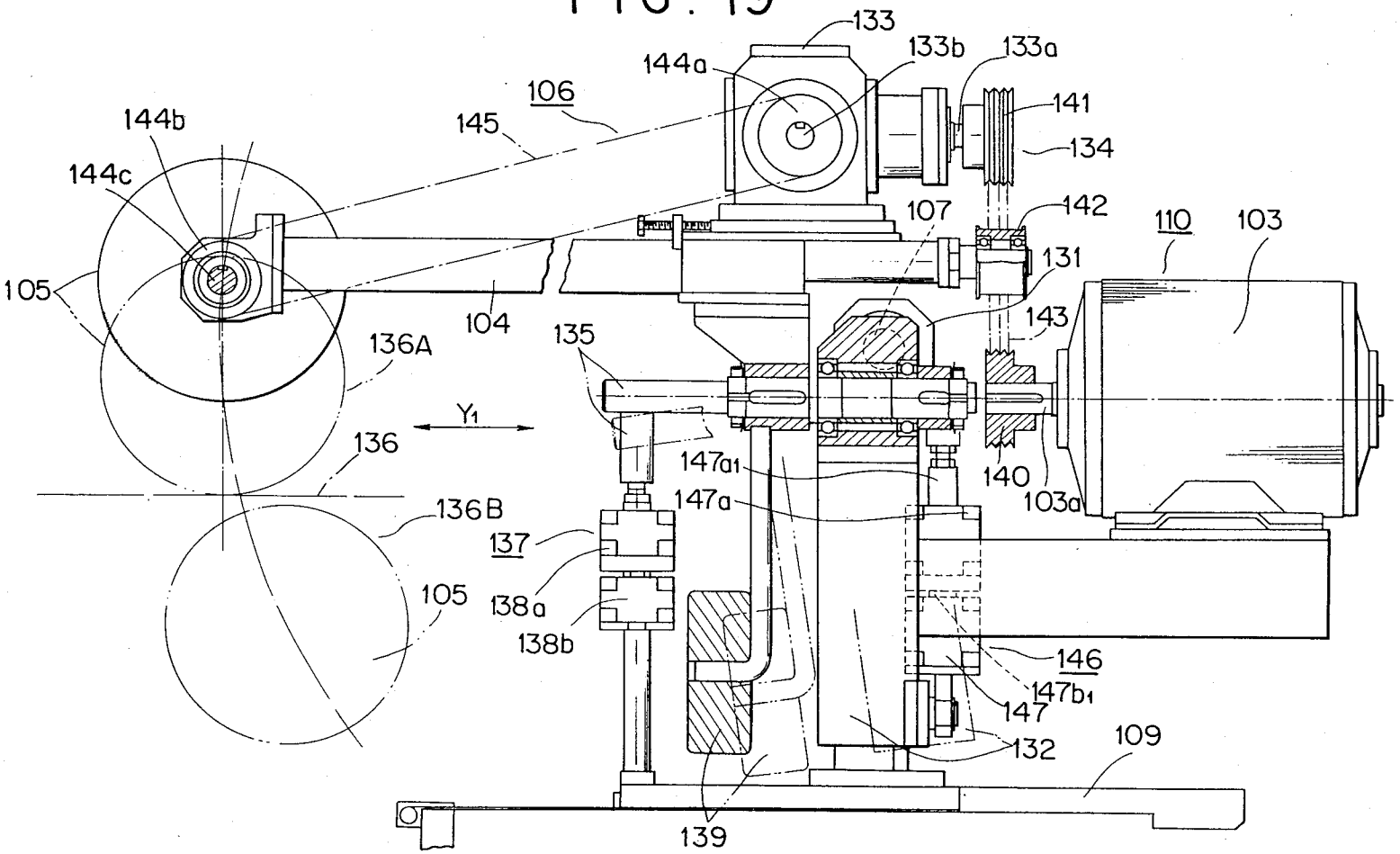
FIG. 19 is a side view partly in section of a shoe making machine according to the present invention.
Figure 21:
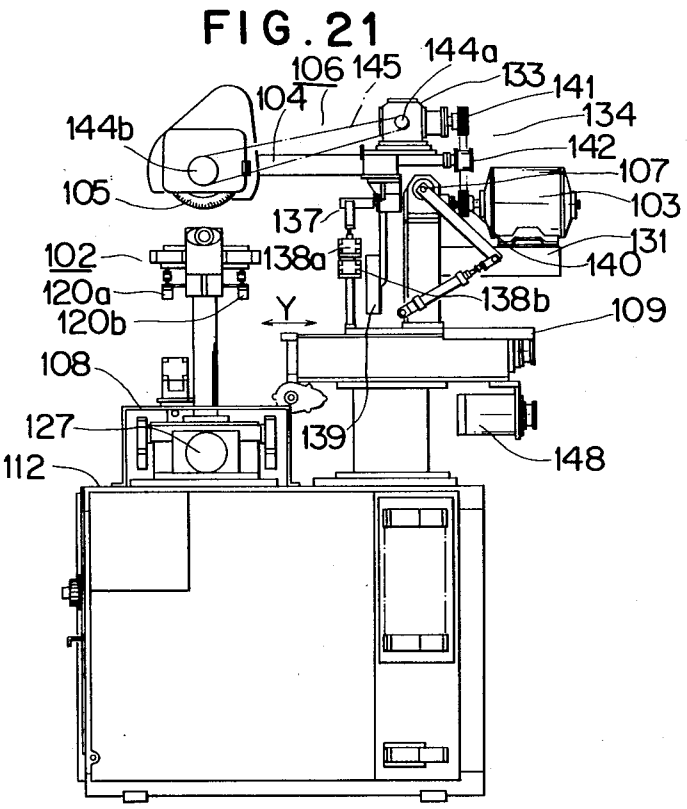
FIG. 21 is likewise the side view of the above.
Figure 20:
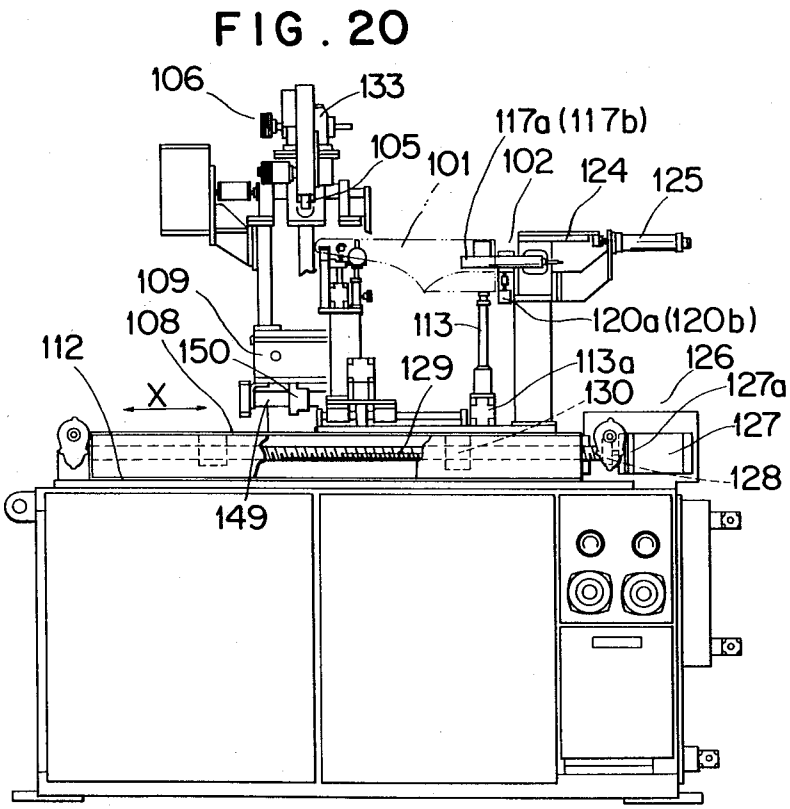
FIG. 20 is likewise a front view showing the whole picture of the shoe making machine of FIG. 16.
Figure 22:
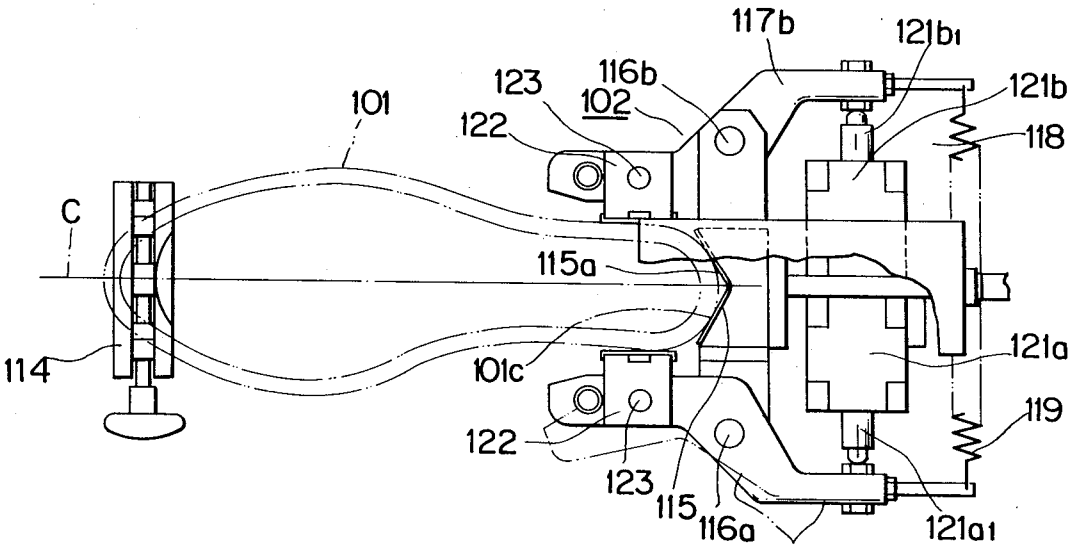
FIG. 22 is a plan view showing one example of clamp mechanism to be used for the shoe making machine of FIG. 16.

In FIGS. 9 and 10, 35 denotes a control panel in which a cassette tape 36 is built. 37 denotes manually setting switches such as digital switches.

Figure 6:
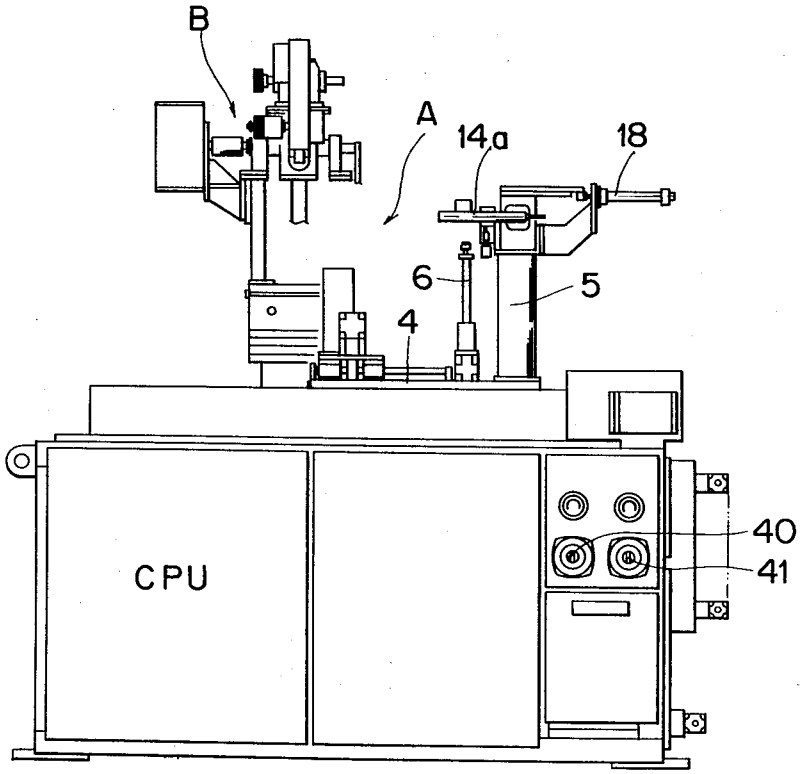
FIG. 6 is a front view of a raising or gluing equipment.

When the "power" switch on the control panel 35 is pressed as shown in FIG. 9, the cassette tape 36 set in the panel 35 is operated to have computer (CPU), as shown in FIG. 6 for memorizing the processing data of a standard sized shoe recorded in said cassette tape 36.

When the "return" switch is pressed, the tiptoe carrying member 11 is returned to its original returning position by means of a fluid system (not shown). Simultaneously, the cylinder 21 is actuated to lift up the lock plate 22 and bring the guide shaft 10*b* to the central portion of the slot 22*a* of said plate 22. While the lower end of the slot 22*b* is mated with the fixed shaft 2*b*.

As a result, although the tiptoe carrying member 11 is locked with respect to the fixed shaft 2*b* through the lock plate 22, the guide shafts 10*a*, 10*b* are in such a state as to be permitted to move through the guide member 12 and along the slot 22*a* of the lock plate 22, respectively. In other words, the slide table 4 is in a movable state.

When the "size" button on the control panel 35 and a size button for the shoe to be processed are pushed sequenially, a driving pulse of the pulse motor 3 which matches the size of the shoe to be processed is commanded in accordance with the operation command of computer (CPU) (refer to FIG. 6) set in the control panel 35 for memorizing the processing data of shoes.

As the pulse motor 3 is driven, the rotary shaft 2 is rotated. In accordance with the movement of the movable supporting member 9 fitted with the rotary threaded shaft portion 2*a*, the slide table 4 is moved toward the right or left direction (not shown), so that the heel portion supporting member 5 is moved into a predetermined position.

Then the tip portion of the shoe is placed on the accommodating member 20 mounted on the tiptoe carrying member 11, and the heel portion rear end outer periphery is abutted against the cushion plate 17 of the heel portion supporting member 5. Simultaneously, the heel portion of the shoe body is placed on the lifting rod 6.

When a set on the control panel is pressed, the cylinder is actuated to progress the regulating plate 19 above the upper surface of the heel portion by means of a fluid system (not shown). Subsequently, the cylinder 7 is actuated to lift up the lifting rod 6 until the heel portion abuts against the regulating plate 19. In this way, positioning of the tiptoe portion on said accommodating member 20 and the shoe heel portion is effected. Reference is made to the position of the shoe S in FIG. 1.

Thereafter, the cylinders 16*a*, 16*b* are operated to force the pair of arms 14*a*, 14*b* to clamp and hold the both side faces of the heel portion against the face of the tension spring 15.

Then, the cylinder 18 stops operating, so that the regulating plate 19 is retreated. Simultaneously, the cylinder 21 stops operating, so that the lock plate 22 is lowered, the upper end of the shaft 22*a* is mated with the guide shaft 10*b*, and the fixed shaft 2*b* is brought to the central portion of the slot 22*b*.

Consequently, the tiptoe carrying member 11 is moved (Y axis direction) in a fixed state with respect to the slide table 4 according to the reciprocal movement of the slide table 4 of the member 11 in order to carry out the succeeding raising or gluing operation.

When a run bottom on the control panel is pushed, the induction motor 33 is driven to rotate the raising or gluing brush 30.

A rotation command is issued with respect to the respective pulse motors 3 and 25 of the shoe setting table A as well as the raising or gluing brush head table B by computer (CPU) memorizing the processing data of the cassette tape 36. As a result, the shoe setting table A is lineally moved (Y axis movement) reciprocally. Simultaneously, the head table B is moved (X and Z axes movements) along the outer marginal portion of the under-surface of the shoe body fixedly secured to the setting table A, so that raising or gluing operation is carried out.

Said cassette tape 36 is recorded with processing data of a standard sized shoe, for example, a minimum size. As shown in FIG. 10, the cassette tape 36 records 60 points for the right and left outer peripheral margin. In other words, programm commands of the Y axis controlling position of $Y_o, \ldots, Y_{60}$ corresponding to the respective Y axis controlling position are recorded in the cassette tape 36 in view of the right and left curved configuration with respect to the center line of the shoe, the concave shape of the arch portion, contra rotation of the brush, etc.

Likewise, computer (CPU) is inputted various kinds of processing data comparing with the processing data of the cassette tape 36.

Consequently, as shown in the system block figure in FIG. 9, when a certain size of a shoe is to be set on the shoe setting table A, the size button of the shoe to be processed is pushed in the afore-mentioned manner. Then, according to the operation command of the computer (CPU) memorizing the data of the cassette tape 36, the heel portion supporting member 5 is moved into a predetermined position. Simultaneously, in order to carry out the succeeding raising or gluing operation, processing code or signal of the shoe to be processed is transmitted to a pulse driver through an interface in order to control the respective pulse motors 25, 3 for the X and Y axes simultaneously.

The movement (Y axis movement) of the shoe setting table A and the movement (X axis movement) of the brush head table B corresponding to the controlling positions of the X and Y axes of the cassette tape 36 are associatingly moved with respect to each other. At the same time, the oscillation for contacting the brush 30 at right angles with respect to the shoe under-face and contra-rotation for preventing the tearing up of the under-surface outer marginal portion are automatically controlled, respectively.

Furthermore, the supporting arm 31 of the brush 30 follows the rise and fall (arch portion, etc.) of the shoe bottom (Z axis) smoothly, since it swings up and down supported by the rotary shaft 37*a* (refer to FIG. 7).

Furthermore, when an error of the position or the contacting angle of the brush 30 with respect to the outer marginal portion of the under-surface is found, or when there is no necessity to brush the heel portions of women's shoes during the aforementioned raising or gluing operation, a correction command can be inputted to the computer (CPU) by means of the manually setting devices 37 such as a digital switch provided on the control panel 35. Also, by automatically finding out the correcting amount for each correcting portion, even a correction of fundamental raising or gluing line can be conducted in accordance with the command from the computer.

Furthermore, the pressure regulation of the brush 30 can be effected by means of a pressure regulating knobs 40 (upward face), 41 (downward face), so that the pressure regulating damper 34 is actuated by the fluid system (not shown).

As described in the foregoing, according to the present invention, a three axes simultaneous controlling system is employed, wherein the movement (Y axis movement) of the shoe setting table and the movements (X and Z axes movements) of the raising or gluing brush head table arranged perpendicular relative to said setting table are simultaneously controlled by the computer. Consequently, the movement of the Y axis and the movements of the X and Z axes are associated, thus enabling to carry out the raising operation or the gluing operation for the raised portion at high accuracy.

Furthermore, since the processing of a shoe of various sizes is carried out under the control of computer based on a processing data of one standard sized shoe recorded in a cassette tape, simple handling of the shoe making machine is obtained.

Referring to FIGS. 14 through 17, a preferred embodiment of a right and left shoe shapes detecting equipment to be used for the shoe making machine according to the present invention will be described.

The present embodiment comprises a right or left shoe body 53 to be processed put on a setting block 52 or mold erected on a table 51 arranged to move reciprocally and with the under-surface outer marginal portion thereof facing upward; a tiptoe supporting member 54 erected on the table 51 and adapted to support the tiptoe portion of the shoe body 53; a heel portion receiving member 55 having a concave portion 55*a* enabling to receive the heel portion 53*a* of said shoe body 53 and arranged spaced apart in the axially longitudinal direction generally at the same height with respect to said tiptoe supporting member 54; a clamp 58 for clamping the heel portion 53*a* of the shoe body 53 including a pair of clamping arms 56, 56 axially supported by shaft portions 57*a*, 57*b* in such a manner as to be opened and shut and generally in the same configuration with respect to each other, said heel receiving member 53 being arranged in the central portion on a plane in such a manner as to be enclosed by said arms 56, 56 from the outside; an actuating means 59 for shutting said pair of clamping arms 56, 56; a tension spring 60 stretched between the rear ends of said clamping arms 56, 56; and two rotary encodes 61*a*, 61*b* adapted to serve as an electrically detecting means for detecting and encoding the rotary angles of said two shaft portions 57*a*, 57*b*, respectively. Bidirectional pneumatic cylinders 62*a*, 62*b* as an example of said actuating means 59 are arranged in parallel so that said respective clamping arms 56, 56 are pushed apart or expanded at the rear side portions by the cylinder rods 63*a*, 63*b* of said pneumatic cylinders 62*a*, 62*b* against the force of said tension spring 60.

64 denotes a pair of presser plates pivotally supported by shafts 65 at the insides of the tip portions of the respective clamping arms 56, 56 of said clamp 58. Said presser plates 64, 64 are employed because when the heel portion 53*a* of the shoe body 53 are clamped, a difficulty arises. That is, since the external configuration of the shoe body 53 is different between the inside $53b_1$ and the outside $53b_2$ of the bottom face outer marginal portion thereof, pivotally moving amounts around the shafts 57*a*, 57*b* of the respective clamping arms are different. 66 denotes a slide presser provided on the over surface of said clamp 58, and movable forward and backward by said pneumatic cylinder 67. These slide pressers 66 are caused to progress above the over-surface of the heel portion 53*a* of the shoe body 53 to press the over-surface thereof before the shoe body 53 is clamped at the both sides by said clamp 58. 68 denotes a lifting rod to which said setting block 52 is attached. The shoe body 53 clamped by the clamp 58 is clamped and hold from both up and down side thereof by means of the association of the lift rod 68 with the slide presser 66.

69 denotes a brush having a group of raising hairs formed of a stiff material such as a wire on its periphery. This brush 69 is employed to grind the margin to glue up of the shoe body 53 while revolving normally and reversely along the inside $53b_1$ and the outside 53*b* of the bottom face marginal portion (upper side in FIG. 14) corresponding to the overlap width of said shoe body 69 with respect to the center line C in the axially long direction.

70 denotes an abrasive unit including a motor 71 for driving normally or reversely the brush 19 and arranged to be movable in the Y axis direction Y perpendicularly intersecting on the same plane with respect to the table 51 movable in the X axis direction X. The revolving direction of said motor 71 is controlled under one data inputted based on one of the shoe bodies 51, for example, a right side shoe as a model size. The rotation of the motor 71 is transmitted to the brush 69 for rotation by means of a motor shaft 71*a*, pulleys 72, 73 and 74; a miter gears box 76 through a belt 75; and pulleys 77 and 79 through a belt 78. 80 denotes a driving motor for moving said table 51 carrying said clamp 58 and setting block 52 thereupon in the X axis direction X. Said table 51 is reciprocally moved in the X axial direction by a method, wherein for example, the motor 80 revolves a screw rod 83 through a coupling 82 provided on a motor shaft 81*a* and a hold nut 84 fastened to said screw rod 83 is firmly fixed to the under-face of the table 51 for the movement in the X axis direction. Likewise, a table 51' carrying said abrasive unit 70 thereupon is reciprocally moved in the Y axis direction by transmitting the driving force of a motor 30' to, for example, a screw rod 83' and a hold nut 84' through a coupling 82'. It should be noted that the above method to move the table 51 in the X axis direction and the table 51' in the Y axis direction are described only as an example, and not intended to limit to the above.

With the above constitution, when a pair of shoe bodies 53, 53 are to be ground, a left side shoe body 53, for example, is put on the setting block 52 on the table 51. Then, when the "power" button as well as the "set" button on a control panel are pressed, the slide presser 66 is progressed above the over-surface of the clamp 58. Thereafter, the pneumatic cylinder 68*a* is actuated to lift up the lifting rod 68 with the shoe body 53 putting thereupon. As a result, the shoe body 53 is clamped and held by the slide presser 66 and the setting block 52 from the up and down sides. Thereafter, since the pneumatic cylinder 62*a*, 62*b* are actuated to expand the pair of cylinder rods 63*a*, 63*b* outwardly against the force of the tension spring 60, the pair of clamping arms 56, 56 are shut at the tip end sides thereof around the two shaft portions 57*a*, 57*b* to clamp the heel portion 53*a* of the shoe body 53. In this case, the rotary angles of the shaft portions 57*a*, 57*b* axially supporting the pair of clamping arms 56, 56 respectively are different. Therefore, the rotary encodes 61*a*, 61*b* can directly detect the difference and encode the same. The code or signal thus obtained is processed by the computer to find the differences of the rotary angles of the two shaft portions 57*a*, 57*b*. By comparing the differences of the rotary angles, the computer can tell whether the one of the shoe bodies 53, 53 is for the right or the left side. Therefore, the motor 71 of the abrasive unit 70 is driven to revolve the motor shafts 71*a*. As a result, the driving force of the motor is transmitted to the pulley 72 mounted on the motor shaft 71*a* as well as to the pulley 73 and the belt 75 for the succeeding step. Furthermore, the driving force from the belt 75 is transmitted to the miter gears box 76 through the pulley 74 and then through the pulley 77, the belt 78 and the pulley 79. As a result, the brush 69 is rotated normally. On the other hand, the table 51 having the shoe body 53 clamped by the setting block 52 is progressed, since the motor 80 which is controlled by computer of the speed and direction thereof is driven by the screw rod 83 within the hold nut 84 through the coupling 82 mounted on the output shaft 81a of the motor 80. Because of the foregoing, the under-surface outer marginal portion corresponding to the margin to glue up the shoe body 53 clamped by the setting block 52 on the table 51 is subjected to the abrasive operation by the brush 69 from the tiptoe portion of, for example, the outside $53b_2$ with respect to the center line C in the longitudinal direction on the plane to the heel portion 53*a* in such a manner as to brush from the outside to the inside, so that tearing up is prevented. When the brushing of the outside $53b_2$ on the under-surface outer marginal portion of the shoe body 53, i.e., brushing down to the center of the heel portion 53*a* is carried out by the brush 69, the motor 71 is revolved reversely by computer. As a result, the brush 69 is also caused to revolve reversely. Since the screw rod 83 is revolved through the coupling 82, the table 51 is retreate.d Consequently, the inside $53b_1$ of the under-surface outer marginal portion of the shoe body 53 clamped on this table 51 is brushed from the outside to the inside.

When the brushing operation of the under-surface outer marginal portion of the shoe body 53 is finished in this way, the cylinder rods 13*a*, 13*b* of the pneumatic cylinders 62*a*, 62*b* are contacted. As a result, the pair of clamping arms 56, 56 are opened at the tip portions thereof due to the force of the tension spring 60 around the shaft portions 57*a*, 57*b*, so that the shoe body 53 is relieved from clamping. After the lifting rod 68 having the setting block 52 with the shoe body 53 putting thereupon on the top thereof is lowered to a predetermined level, the pneumatic cylinder is decompressed to retreat the heel receiving member 55. Since the pneumatic cylinder 67 is decompressed, the slide presser 66 is retreated from the upper surface of the clamp and brushing operation for the left side of the shoe body 53 is completed.

Likewise, when the brushing operation is carried out for the right side of the shoe body 53, the slide presser 66 progresses above the clamp 58 first in the same manner as mentioned above. Secondly, the heel portion 53*a* of the shoe body 53 is clamped by the pair of arms 56, 56 of the clamp 58. The differences of the rotary angles of the shaft portion 57*a*, 57*b* axially supporting said pair of clamping arms 56, 56 are encoded by the rotary encoders 61*a*, 61*b*. Then, the differences of the rotary angles are processed by the computer to detect the right and left shoe bodies 53, 53, because of the differences in shape therebetween. After the lifting rod 68 having the setting block 52 on the top thereof is lifted up, the brush 69 is caused to revolve normally or reversely and the table 51 mounting the brushing unit 70 thereupon is moved back and forth. In this way, the brushing operation on the under-surface outer marginal portion of the right shoe body 53 is finished.

The brushing operation of the pair of right and left shoe bodies 53, 53 can be carried out in the above described manner.

In this embodiment, description is made on the case in which the present detecting equipment is applied to a brushing tool of the shoe body. However, it can be applied to a gluing equipment for spreading an adhesive agent on the under-surface outer marginal portion of the pair of shoe bodies 53, 53 for attaching the shoe bodies 53, 53 to a shoe bottom member (not shown) after the brushing operation of the shoe body is finished, or to a primer processing equipment to be used for jetting an adhesive agent from the nozzle.

In the above embodiment, one of the shoe bodies 53, 53 to be processed is detected whether it is a right side or left side shoe by electrically detecting the change of opening or shutting amount of the pair of clamping arms 56, 56 of the clamp 58. Alternatively, a variable resistor may be used as a detecting means, or otherwise a magnetic scale may be used for detecting the change of magnetic amount in order to transfer it to an electric amount. The detector can be made small in its size with high accuracy and prompt response. Furthermore, a large installation space is not required. Moreover, since no parts for motion transmittance such as a link are required, labor can be saved for its assembly, and an easy assembly can be obtained. In the above embodiment, description is made for the case in which the present equipment is applied to detect the right or left side of the under-surface outer marginal portion of the shoe body, but it can be used for detecting the right or left side of completed shoes.

As described in the foregoing, according to the equipment of the present invention, since the shaft portion axially supporting the pair of clamping arms which constitute the clamp is connected to the rotary encoder, one of the shoes to be processed can be detected whether it is a right or left shoe body only by clamping it on the same table. Based on such obtained code or signal, the motor for driving the brush can be revolved normally or reversely in order to effect the brushing operation or gluing operation of the under-surface outer marginal portion of the both right and left shoe bodies.

Referring to FIGS. 19 through 24, a preferred embodiment of a shoe making machine according to the present invention will be described.

This embodiment comprises a brushing unit 106 including a clamping mechanism 102 for clamping a shoe body 101 in the setting position, a motor 103 for revolving normally or reversely depending on the inside 101*a* or outside 101*b* of the shoe body 101 with respect to the center line C dividing the shoe body 101 into substantially equal two portions, i.e. the inside 101*a* and the outside 101*b*, in the axially longitudinal direction, said brushing unit 106 being swingably supported by a swing shaft 107 and extended in the X axis direction X; a Y axis direction movable table 109 in the intersecting direction at right angles with respect to the X axis direction movable table 108 on the same plane; and a driving means 137 for revolving the brush 105 around the swing shaft 107 in order to determine the height of its position with respect to the shoe body 101.

111 denotes a setting block for putting the shoe body 101 thereupon. Said setting block 111 is mounted on the top of a lifting rod 113 erected on said X axis direction movable table 108 which is designed to be movable in the X axis direction X on a base 112. 114 denotes a tiptoe supporting member erected on the upper face of said X axis movable table 108. Said tiptoe supporting member 114 is employed for supporting the tiptoe of the shoe body 101 which is clamped by the clamp mechanism 102 as will be described later. Said clamp mechanism 102 comprises a heel receiving member 115 having a concave portion 115*a* enabling to receive the heel portion 101*c* of the shoe body 101 and arranged spaced apart in the axially longitudinal direction generally at the same height with respect to said tiptoe supporting member 115; a pair of clamping arms 117*a*, 117*b* substantially in the same configuration with respect to each other having the heel receiving member 115 arranged in the center thereof and axially supported by shaft portions 116*a*, 117*b* in such a manner as to be opened or shut in order to clamp the heel portion 101*c* of said shoe body 101; an actuating means 118 for actuating said clamping arms 117*a*, 117*b*; a tension spring 119 stretched between the rear ends of the clamping arms 17*a*, 17*b*; and rotary encoders 120*a*, 120*b* for detecting and encoding the torque amount due to the differences of the rotary angles of said two shaft portions 116*a*, 116*b*, respectively. As an example of such actuating means 118, bidirectional pneumatic cylinders 121*a*, 121*b* are arranged in parallel so that said respective clamping arms 117*a*, 117*b* are pushed apart or spread outward at the rear side portions by the cylinder rods 121*a*$_1$, 121*b*$_1$ in said pneumatic cylinders 121*a*, 121*b* against the force of said tension spring 119. 122 denotes a pair of presser plates pivotally supported by shafts 23 at the inside of the tip portions of said clamping arms 117*a*, 117*b*. 124 denotes a slide presser for progressing above the over face of the heel portion 101*c* of the shoe body 101 and pressing said upper surface before the heel portion 101*c* of the shoe body 101 is clamped by said pair of clamping arms 117*a*, 117*b*.

26 denotes a driving means for reciprocally moving said X axis direction movable table 108 in the X axis direction or the axially longitudinal direction of the shoe body 101. As an example of such driving means, the driving force of a motor 127 fixed to one side of the over-surface of said base 112 is transmitted from a motor shaft 127*a* to a screw rod 129 on the coaxis for rotation through a coupling 128; said screw rod 129 is fastened to a hold nut 30 which is fixed to the under-surface of said X axis direction moving table 108. The arrangement being such that when the motor 127 is driven, the X axis direction moving table 108 is reciprocally moved in the X axis direction. It should be understood that the above reciprocal movement of the table 101 in the X axis direction is described only as an example and not intended to limit to the one shown in the drawings.

Figures 23A, 23B, 23C:
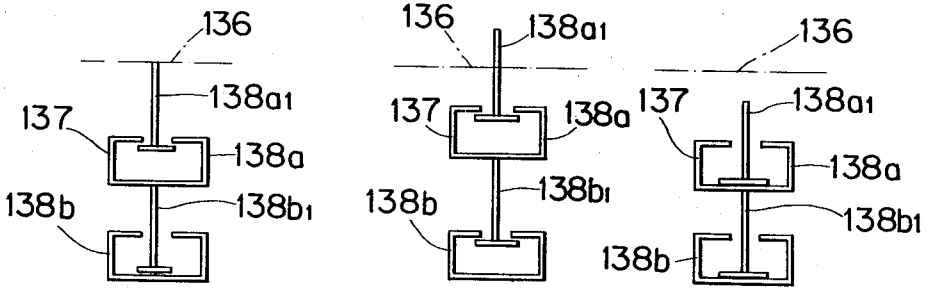

Said brushing unit 106 comprises a supporting frame 131 erected in front of the Y axis movable table 109 in the Y axis direction on said base 112 in such a manner as to intersect on the same horizontal plane with respect to said X axis direction movable table 108; an L-shaped movable frame 132 in section swingably mounted on the supporting frame 131 around the swing shaft 107 disposed in the X axis direction; said motor 103 revolving a brush as a processing tool fixed to one side over-surface in a nonsensitive position of this movable frame 132; a transmitting means 134 for transmitting the output from the output shaft 103*a* of said motor 103 to a mechanical portion in the succeeding step including a miter gears box 133 as a power converting mechanism; an abrasive brush 105 bendingly secured to the tip portion of the supporting arm 104 extended from said movable frame 132 at the installing side of the shoe body 101; a whirling shaft 135 permitted to rotatably penetrate through said movable frame 132 in such a manner as to intersect at right angles with respect to the lower center of said swing shaft 107; a twin pneumatic cylinders 138*a*, 138*b* as a driving means 137 for brushing the inside 101*a* and the outside 101*b* of the bottom outer marginal portion of the shoe body 101 by pushing up the brush 105 higher than a neutral point 136 as a standard level for determing the mounting position of the brush 105 revolvingly attached to the tip portion of the supporting arm 104 around said swing shaft 135 at its one end with respect to the shoe body 101, or by lowering the mounting position of the brush 105 than said neutral point 136; and a balancing weight 139 hanging down from said shaft 135 of the mounting side of the brush 105 in such a manner as to contact the brush 105 by means of a moderate pushing force with respect to said shoe body 101. Said transmitting means 134 comprises a pulley 140 mounted on the output shaft 103*a* of said motor 103; an intermediate pulley 142 provided between said pulley 140 and a pulley 141 mounted on the input shaft 133*a* of said miter gears box 133; a belt 143 stretched between said pulleys 140, 141 and transmitting the output from the motor 103 to the miter gears box 133; a pulley 144*a* mounted on the output shaft 133*b* of the miter gears box 133; a pulley 144*b* mounted on a mounting shaft 144*c* of the brush 105; and a belt 145 stretched between said pulleys 144*b* and 144*a*. Referring to FIG. 23, when the brush is in the neutral point 136 as shown in FIG. 23*a*, only the cylinder rod 138*a*$_1$ of the upper pneumatic cylinder 138*a* is extended and the cylinder rod 138*b*$_1$ of the lower pneumatic cylinder rod 138*b* is contracted. When the brush 105 is in the upper position than the neutral point 136*a* as shown in FIG. 23*b*, the cylinder rods 138*a*, 138*b* are extended. Likewise, when the brush 105 is in the lower position than the neutral point 136 as shown in FIG. 23*c*, the cylinder rods 138*a*$_1$, 138*b*$_1$ of the both upper and lower pneumatic cylinders 138*a*, 138*b* are used for lifting the shaft 135 so that the brush 105 can be lifted up and down with good response. 146 denotes a driving means for pushing up said shaft 135 in order to pull apart said brush 105 from the shoe body 101 in accordance with necessity. Twin pneumatic cylinders 147*a*, 147*b* having the same structure as that of said driving means 137 are employed as such driving means 146.

When only the cylinder rod 147$a_1$ of the upper pneumatic cylinder 147*a* is extended, the shaft 135 is in the neutral point. When the both cylinder rods 147$a_1$, 147$b_1$ of the upper and lower pneumatic cylinders 147*a*, 147*b* are extended, the shaft 35 is in the upper position than the neutral point. Likeiwse, when the both cylinder rods 147$a_1$, 147$b_1$ of the pneumatic cylinders 147*a*, 147*b* are contracted, the shaft 103 is in the lower position than the neutral point. Furthermore, said motor 103 for revolving the brush 105 is controlled by computer in such a manner as to continuously revolve normally or reversely at the central bisector C as the boarder line. Said Y axis direction movable table 109 is also reciprocally moved since a screw rod 149 driven by the output of a motor 149 is fastened to a hold nut 150 which is fixed to the under-surface of the movable table 109. It should be understood that the reciprocal movement of this movable table 109 in the Y axis direction is described as an example and not intended to limit to the one shown in the drawings.

With the above constitution, when a pair of right and left shoe bodies 101, 101 are to be ground, the right shoe body 101, as an example, is put on the setting block 111 on the X axis direction movable table 108. Then, a "power" button and a "set" button provided on the control panel are pushed so that the slide presser 124 is progressed above the over-surface of the clamp mechanism 102. Thereafter, since the pneumatic cylinder 113*a* is actuated to lift up the lifting rod 113 having the setting block 111 with the shoe body 101 putting thereupon, the shoe body 101 is clamped by both the slide presser 124 and the setting block 111 from both up and down sides. Then, the pneumatic cylinders 121*a*, 121*b* are actuated to extend the pair of cylinder rods 121$a_1$, 121$b_1$ outward against the force of the tension spring 119. As a result, the pair of clamping arms 117*a*, 117*b* are shut at the tip portions thereof around the two shaft portions 116*a*, 116*b* to clamp the heel portion 101*c* of the shoe body 101 for determining the setting position. In this case, the rotary angles of the shaft portions 116*a*, 116*b* axially supporting the pair of clamping arms 117*a*, 117*b* respectively are different. Therefore, the pulse generated depending on the torque amount thereof are encoded by the rotary encoders 120*a*, 120*b*. These input codes are processed by computer and by comparing the differences of the both of them under a processed data, the one of the shoe bodies 101, 101 can be determined whether it is the right side or left side shoe body. Thereafter, the output shaft 103*a* of the motor 103 of the abrasive unit 106 is revolved to transmit the output from the motor 103 to the input shaft 133*a* of the miter gears box 133 by means of the belt 143 through the pulley 40 mounted on the output shaft 103*a* and through the intermediate pulley 142. Furthermore, the output from the output shaft 133*b* of the miter gears box 133 is transmitted to the pulley 144*a*, the belt 145 and the pulley 144*b*. As a result, the brush is revolved normally.

Thereafter, the X axis movable table 108 carrying the shoe body 101 clamped by the setting block 111 is progressed in the X axis direction since the motor 127 controlled at its speed as well as revolving direction by computer is driven to revolve the screw rod 129 arranged coaxis with the output shaft 127*a* through the coupling 128 within the hold nut 130. Furthermore, since the output of this motor 148 is transmitted to the screw rod 149 for rotation, the Y axis direction movable table 109 having the hold nut 150 fastened to the screw rod 149 on its under-surface is moved in the Y axis direction on the same plane with respect to the X axis direction movable table 108 clamping the shoe body 101.

Furthermore, since the output rods 138$a_1$, 138$b_1$ of the twin pneumatic cylinders 138*a*, 138*b* repeat the movement of extension and contraction in a short and quick manner as shown in FIGS. 23*a* through 23*c*, the shaft 135 thrushed into the movable frame 131 is pushed up starting from the neutral point 136 as a standard level or lowered at its supporting height, the movable frame 131 is swung around the swing shaft 107 to determine the mounting height of the brush body 105 with respect to the shoe main body 101. Consequently, the outer side 101*b* of the under-surface outer marginal portion of the shoe body 101 with the central bisector C in the axially longitudinal direction as the boarder line is ground from the tiptoe portion toward the heel portion 101*c*. When the outer side 101*b* of the under-surface outer marginal portion is ground until the heel portion 101*c*, the motor is caused to revolve adversely. As a result, the revolving direction of the brush 105 is reversed. At the same time, since the motor 127 is revolved adversely, the X axis direction movable table 108 is retreated. Due to the motor 148 driven, the movement of the Y axis direction movable table 109 is repeated in the Y axis direction. Consequently, the inside 101*a* of the under-surface outer marginal portion of the shoe body 101 with the central bisector C in the axially longitudinal direction as the boarder line is ground from the heel portion toward the tiptoe portion this time. In this case, when it is unnecessary to grind a part of the undersurface outer marginal portion, such as, for example, the heel portion of the women's high-heel shoes, since the both two cylinder rods 147$a_1$, 147$b_1$ of the twin pneumatic cylinder 147*a*, 147*b* are extended to push up the shaft 135, the brush 105 is separated from the shoe body 101. As a result, the heel portion 101*c* is not brushed. In this case, if the time is controlled for pushing up the shaft 135, the distance of non-brushing area can be easily controlled. Furthermore, since the motor 103 for revolving the brush 105 is revolved normally or reversely with the central bisector in the axially longitudinal direction as the boarder line, the inside 101*a* and the outside 101*b* of the shoe body 101 are ground from the outside toward the inside. Consequently, the tearing up of the under-surface outer marginal portion of the shoe body 101 due to the friction with the brush 105 can be prevented. Furthermore, unfavorable deformation of the brush 105 itself can be avoided.

In this way, when the abrasive operation or brushing operation with respect to the under-surface outer marginal portion of the shoe body 101 is finished, the cylinder rods 121$a_1$, 121$b_1$ within the pneumatic cylinders 121*a*, 121*b* are contracted. As a result, the pair of clamping arms 117*a*, 117*b* are opened at the tip portions thereof around the shaft portions 116*a*, 116*b* due to the force of the tension spring 119, thereby opening the clamp for the shoe body 101. After the lifting rod 113 having at its top the setting block 111 with the shoe body 101 putting thereupon and the lifting rod of the tiptoe supporting member 114 are lowered to a predetermined height, the pneumatic cylinder is decompressed to retreat the heel receiving member 115. Furthermore, since the pneumatic cylinder 125 is decompressed, the slide presser 124 is retreated from the over-surface of the clamp 102 to complete the abrasive operation or brushing operation of the shoe body 101.

Likewise, when the abrasive operation or brushing operation for the left side shoe body 101 is carried out, the slide presser 124 is progressed above the clamp 102 first in the same manner as described above. Then, the heel portion 101*c* of the shoe body 101 is clamped by the pair of clamping arms 117*a*, 117*b*. Then, the torque amounts due to the differences of the rotary angles of the shaft portions 116*a*, 116*b* supporting the pair of clamping arms 117*a*, 117*b* are encoded by the rotary encoders 120*a*, 120*b*. The thus obtained codes or signals are processed by the computer to detect the left side shoe body 101 with respect to the right side shoe body 101 because of the differences. In the above description, the change or displacement of the opening or shutting motion amount of the pair of clamping arms 117*a*, 117*b* of the clamp mechanism 102 are electrically detected by the rotary encoders 110*a*, 110*b* to determine whether the shoe body 101 is for the right side or left side. Alternatively, a variable resistor may be employed or otherwise a magnetic scale may be employed for converting into electric amount. Thereafter, the lifting rod 113 having the setting block 111 on the top thereof is lifted up to move the X axis direction movable table 108 back and forth, while the Y axis direction movable table 109 mounting the abrasive unit 106 or brush unit is moved back and forth in the same horizontal plane in the Y axis direction with respect to the X axis direction movable table 108. In the meantime, the brush 105 is revolved normally or reversely, thereby finishing the abrasive operation or brushing operation of the under surface outer marginal portion of the left side shoe body 101.

In this way, the abrasive operation or brushing operation of the pair of right and left shoe bodies 101, 101 can be carried out.

Figure 24:
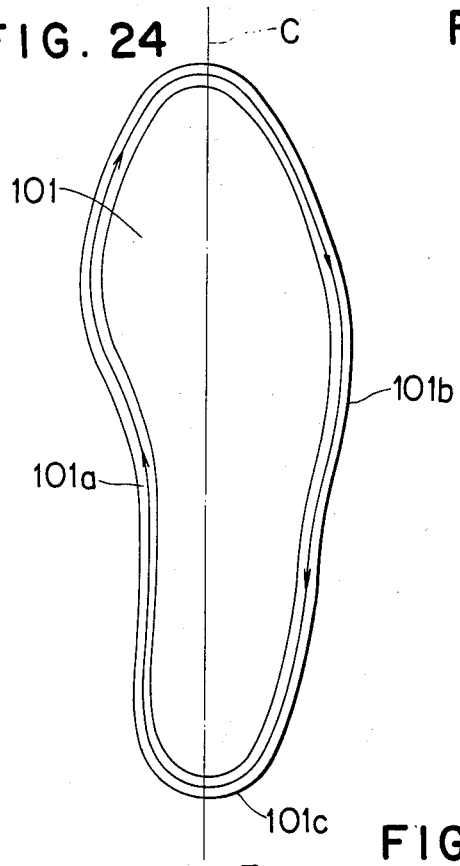
FIG. 24 is likewise a plan view schematically illustrating the sequence of the abrasive operation on the undersurface of the shoe body.
Figure 30:
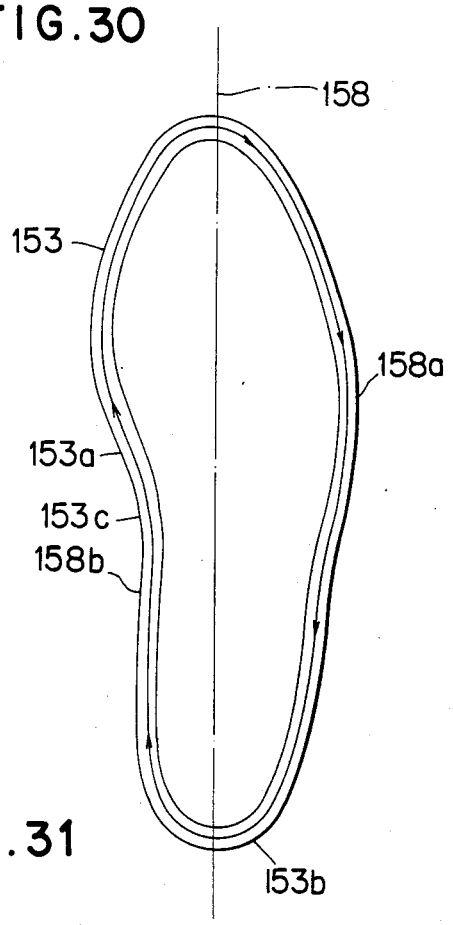
FIG. 30 is a bottom view showing the sequence of the abrasive operation on the outer marginal portion of the under-surface of the shoe body by using the shoe making machine of FIG. 25.
Figure 31:
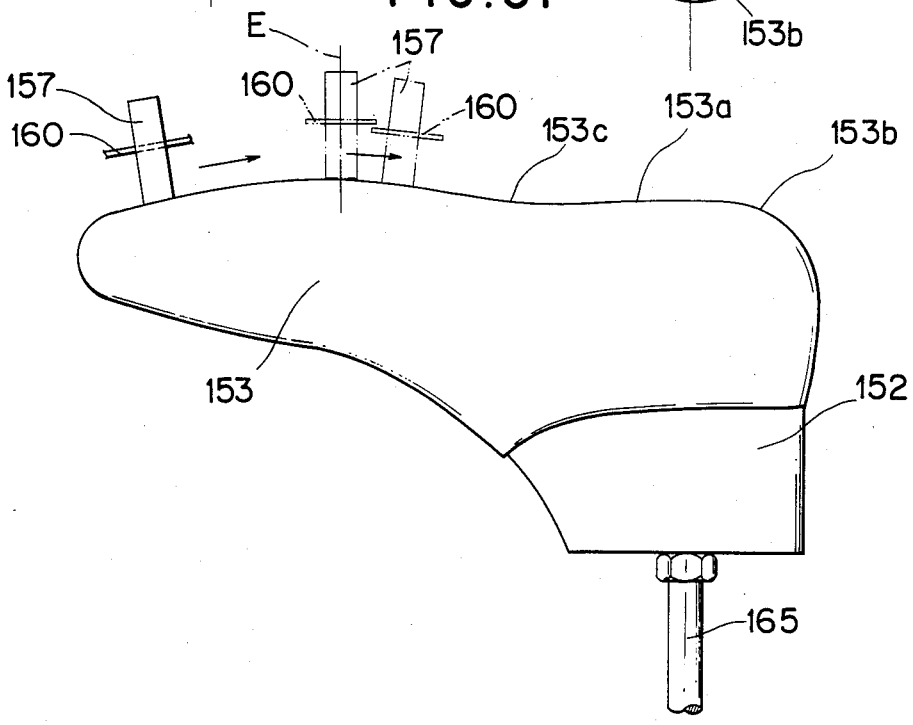
FIG. 31 is likewise a side view of the above.

In the above embodiment, the abrasive operation of the under surface outer marginal portion of the shoe body 101 is carried out by the brush 105 in the sequence as shown by an arrow in FIG. 24. However, when the dimension of the undersurface outer marginal portion to be processed is vast, or when the material of the shoe body 101 is too hard or too soft, it is necessary to carry out more sufficient abrasive operation. In such case, the abrasive operation can be carried out once again in the opposite direction relative to the direction shown by the arrow in FIG. 24 by revolving the brush 105 adversely in the corresponding position, either wholly or partly, in accordance with necessity.

In the above embodiment, the present invention is applied to an abrasive equipment to be used for the shoe making machine. However, it can also be applied to other equipments such as a gluing equipment for spreading glue on the under-surface outer marginal portions of a pair of shoes 101, 101, a primer for jetting an adhesive agent from the nozzle, etc. which are chiefly used to process the bottom member of the shoe after the brushing operation is finished in order to attach the shoe body to the bottom member.

As described in the foregoing, according to the present invention, the abrasive operation of the under-surface outer marginal portion of a pair of shoe bodies can be carried out speedily without using a model member as a copy and by controlling the revolving direction of only one motor for actuating the processing tool at a predetermined position with respect to the shoe body only by means of inputting processing data of one side shoe body. Furthermore, since the number of motor for driving the processing tool is fewer than that of the conventional abrasive equipment, cost reduction can be achieved. In addition, the service life of the abrasive brush as a processing tool can be prolonged, since the brush can be revolved normally or reversely at a predetermined position, thus avoiding unfavorable deformation.

Referring to FIGS. 25 through 32, another preferred embodiment of a shoe making machine according to the present invention will be described.

This shoe making machine embodying the invention comprises one of a pair of shoe bodies 153, either right or left, put on a setting mold or block 152 erected on a table 151 movable reciprocally in the X axis direction in such a manner as to face the under-surface outer marginal portion 153*a* of said shoe body 153 upward; an abrasive unit 155 mounted on the upper surface of a table 154 reciprocally movable in the Y axis direction in such a manner as to intersect at right angles with respect to said X axis direction movable table 151 on the same horizontal plane; a brush 157 constituting a part of said abrasive unit 155 and rotatably provided in the intersecting direction at right angles relative to the axially longitudinal direction of said shoe body 153 through a supporting arm 156; a driving motor 159 also constituting a part of said abrasive unit 155 and continuously revolving said brush 157 normally or reversely at the outside 158*a* and inside 158*b* with respect to the central bisector 158 of the shoe body 153 in the axially longitudinal direction as a boarder line under the control of computer; a swing shaft 186 disposed perpendicular to a supporting shaft 186 arranged parallel to said mounting shaft 160 in order to normally contact the brush 157 intimately and flatly with the under-surface outer marginal portion 153*a* of the shoe body 153 irrespective of the unevenness of the surface by means of pivotal swinging in the width direction of the brush 157; and driving means 163 for driving said brush 157 in a swingable manner around said shaft 186 so that the brush 157 may normally contact flatly on the under-surface outer marginal portion 153*a* of the shoe body 153 depending on the surface unevenly formed. Said means 163 may be electrically controlled under processed data which are inputted and memorized by computer beforehand.

Said setting block 152 is mounted on top of a lifting rod 165 erected on said X axis direction movable table 151 movable in the X axis direction on a base 164. 166 denotes a tiptoe supporting member erected on the upper face of said X axis movable table 151. Said tiptoe supporting member 166 is employed for supporting the tiptoe portion of the shoe body 153 which is clamped at its heel portion 153*b* by the clamp mechanism 167 as will be described later. Said clamp mechanism 167 comprises a heel receiving member 168 having a concave portion 168*a* enabling to receive a heel portion 153*b* of the shoe body 153 and arranged spaced apart in the axially longitudinal direction generally at the same height with respect to said tiptoe supporting member 166; a pair of clamping arms 170*a*, 170*b* substantially in the same configuration with respect to each other having the heel receiving member 168 arranged in the center thereof and axially supported by shaft portions 169*a*, 169*b* in such a manner as to be opened or shut in order to clamp the heel portion 153*b* of said shoe body 153; an actuating means 171 for actuating said clamping arms 170*a*, 170*b*; a tension spring 172 stretched between the rear ends of the clamping arms 170*a*, 170*b*; and rotary encodes 173*a*, 173*b* for detecting and encoding the torque amount due to the differences of the rotary angles of said two shaft portions 169*a*, 169*b* respectively. As an example of such actuating means 171, bidirectional pneumatic cylinders 174*a*, 174*b* are arranged in parallel so that said respective clamping arms 170*a*, 170*b* are pushed apart or spread outward at the rear side portions by the cylinder rods $174a_1$, $174b_1$ in said pneumatic cylinders 174*a*, 174*b* against the force of said tension spring 172.

175 denotes a slide presser for progressing above the over face of the heel portion 153*b* of the shoe body 153 and pressing said upper face before the heel portion 153*b* of the shoe body 153 is clamped by said pair of clamping arms 170*a*, 170*b*.

177 denotes a driving means for reciprocally moving said X axis direction moving table 151 in the X axis direction or the longitudinal direction of the shoe body 153. As an example of such driving means 177, the dirving force of a motor 179 fixed to one side of the over surface of said base 164 is transmitted from a motor shaft 179*a* to a screw rod 181 on the coaxis for rotation through a coupling 180; said screw rod 181 is engaged with a hold nuts 182, 182 which are fixed to the under-surface of said X axis direction moving table 151. The arrangement being such that when the motor 179 is driven, the X axis direction moving table 151 is reciprocally moved in the X axis direction. It should be understood that the above reciprocal movement of the table 151 in the X axis direction is described only as an example and not intended to limit to the one shown in the drawings.

Said brushing unit 155 comprises a supporting frame 162 erected in front of the Y axis movable table 154 movable in the Y axis direction on said base 164 in such a manner as to intersect on the same horizontal plane with respect to said X axis direction movable table 151; an L-shaped movable frame 183 in section swingably mounted on the supporting frame 161 around the supporting shaft 167 disposed in the X axis direction; said motor 159 for revolving a brush fixed to one side over surface in a nonsensitive position of this movable frame 183; a transmitting means 185 for transmitting the output from the output shaft 159*a* of said motor 159 to a mechanical portion in the succeeding step including a miter gears box 184 as a power converting mechanism; and a twin pneumatic cylinders 187*a*, 187*b* arranged to swing the movable frame 183 around the swing shaft 186 disposed perpendicular to the supporting shaft 162 parallel to the mounting shaft 160 of the brush 157 and supporting the movable frame 183 having at its one side the supporting arm 156 supporting the brush 157 in order to flatly contact the brush 157 to the uneven surface for example, a concave portion such as the arch 153*c*, or a convex portion such as the heel 153*b* or the outside 158*a*, of the under-surface outer marginal portion 153*a* of the shoe body 153.

188*a*, 188*b* are a twin pneumatic cylinders for brushing the inside 158*a* and the outside 158*b* of the under-surface outer marginal portion 153*a* of the shoe body 153 by pushing up the brush 157 higher than a neutral point Z as a standard level for determining the mounting position of the brush 157 with respect to the shoe body or by pushing it down around said swing shaft 186 supporting one end of said shaft 186. 189 denotes a balancing weight hanging down from said swing shaft 186 of the mounting side of the brush 157 in such a manner as to contact the brush 157 by means of a moderate pushing force with respect to said shoe body 153.

Said transmitting means 185 comprises a pulley 190 mounted on the output shaft 159*a* of said motor 159; an intermediate pulley 192 provided between said pulley 180 and a pulley 191 mounted on the input shaft 184*a* of said miter gears box 184; a belt 193 stretched between said pulleys 180, 191 transmitting the output from the motor 159 to the miter gears box 184; a pulley 194 mounted on the output shaft 184*b* of the miter gears box 184; a pulley 195 mounted on a mounting shaft 160 of the brush 157; and a belt 196 stretched between said pulleys 195 and 194. When the brush 157 is in the neutral point Z as shown in FIG. 32*b*, only the cylinder rod $188a_1$ of the upper pneumatic cylinder 188*a* is extended and the cylinder rod $188b_1$ of the lower pneumatic cylinder rod 188*b* is contracted. When the brush 157 is in the lower position than the neutral point Z as shown in FIG. 32*c*, the cylinder rods $188a_1$, $188b_1$ of the both upper and lower pneumatic cylinders 188*a*, 188*b* are contracted. When the brush 157 is in the upper position than the neutral point Z as shown in FIG. 32*a*, the cylinder rods $188a_1$, $188b_1$ of the both upper and lower pneumatic cylinders 188*a*, 188*b* are extended. The pneumatic cylinders 188*a*, 188*b* are used for lifting the swing shaft 186 so that the brush 157 can be lifted up and down with good response.

197 denotes a driving means for pushing up said swing shaft 186 in order to pull apart said brush 157 from the shoe body 153 in accordance with necessity. As such driving means 197, twin pneumatic cylinders 198*a*, 198*b* having the same structure as that of said driving means 163 are employed. When only the cylinder rod $198a_1$ of the upper pneumatic cylinder 198*a* is extended, the shaft 186 is in the neutral point T. When the both cylinder rods $198a_1$, $198b_1$ of the upper and lower pneumatic cylinders 198*a*, 198*b* are extended, the shaft 186 is in the upper position than the neutral point T. Likewise, when the both cylinder rods $198a_1$, $198b_1$ of the pneumatic cylinders 198*a*, 198*b* are contracted, the swing shaft 186 is in the lower position than the neutral point T. Said Y axis direction movable table 154 is also reciprocally moved since a screw rod 200 driven by the output of a motor 199 is engaged with a hold nut 201 which is fixed to the under-surface of the movable table 154. It should be understood that the reciprocal movement of this movable table 154 in the Y axis direction is described only as an example and not intended to limit to the one shown in the drawings.

202 denotes a retainer adapted to prevent the swinging of said movable frame 183 around said swing shaft 186 and extendedly disposed in the mounting direction of said swing frame 186 of the movable frame 183. 203*a*, 203*b* denote stoppers provided at both sides of said retainer. 204 denotes a rotary actuator. This actuator 204 connects the output shaft 208 to said shaft 162 through a coupling 209, said shaft 208 including a pinion 207 mated with a movable rack 206 due to air pressure applied to the upper and lower chambers within the cylinder 205 in turn. The pressing force of the brush 157 against the shoe body 153 is controlled by displacing the movable frame 183 which has taken place because of the rotation of the pinion 207. The pinion 207 is rotated because of the movement of the rack 206 caused by air pressure applied to the respective chambers of said cylinder 185.

With the above constitution, when a pair of right and left shoe bodies 153 are to be brushed or ground, the right shoe body 153, as an example, is put on the setting block 152 on the X axis direction movable table 151. Then, a power button and a setting button (not shown) provided on a control panel are pushed, the slide presser 175 is progressed above the over-surface of the clamp mechanism 167. Thereafter, since the pneumatic cylinder 165*a* is actuated to lift up the lifting rod 165 having the setting block 152 with the shoe body 153 putting thereupon, the shoe body 153 is clamped by both the slide presser 175 and the setting block 152 from both up and down sides. Then, the pneumatic cylinders 174*a*, 174*b* are actuated to extend the pair of cylinder rods 174*a*$_1$, 174*b*$_1$ outward against the force of the tension spring 172. As a result, the pair of clamping arms 170*a*, 170*b* are shut at the tip portions thereof around the two shaft portions 169*a*, 169*b* to clamp the heel portion 153*b* of the shoe body 153 for determining the setting position. In this case, the rotary angles of the shaft portions 169*a*, 169*b* axially supporting the pair of clamping arms 170*a*, 170*b*, respectively are different. Therefore, the pulse generated depending on the torque amount thereof are encoded by the rotary encoders 173*a*, 173*b*. These inputted codes are processed by computer and by comparing the differences of the both of them under processed data, the one of shoe bodies 153, 153 can be determined whether it is the right or left side shoe body. In the foregoing embodiment, the detection of the right and left shoes is made by rotary decoders 173*a*, 173*b* based on the change of moving amount of the clamp mechanism 167. Alternatively, a variable resistor or magnetic scale may be employed in order to detect the moving amount. Thereafter, the output shaft 159*a* of the motor 159 of the abrasive unit 155 is revolved to transmit the output from the motor 159 to the input shaft 184*a* of the miter gears box 184 by means of the belt 193 through the pulley 190 mounted on the output shaft 159*a* and through the intermediate pulley 192. Furthermore, the output from the output shaft 184*b* of the miter gears box 184 is transmitted to the pulley 194, the belt 196 and the pulley 195. As a result, the brush 157 is revolved normally.

Thereafter, the X axis movable table 151 carrying the shoe body 153 clamped by the setting block 152 is progressed in the X axis direction since the motor 127 controlled at its speed and revolving direction by the computer is driven to revolve the screw rod 181 arranged coaxis with the output shaft 179*a* through the coupling 180 and to revolve the hold nut 182. Furthermore, since the motor 199 is driven, the output of this motor 199 is transmitted to the screw rod 200 for rotation the Y axis direction movable table 154 having the hold nut 201 engaged with the screw rod 200 on its under-surface is moved in the perpendicular direction or the Y axis direction on the same plane with respect to the X axis direction movable table 151 clamping the shoe body 153.

Figure 25:
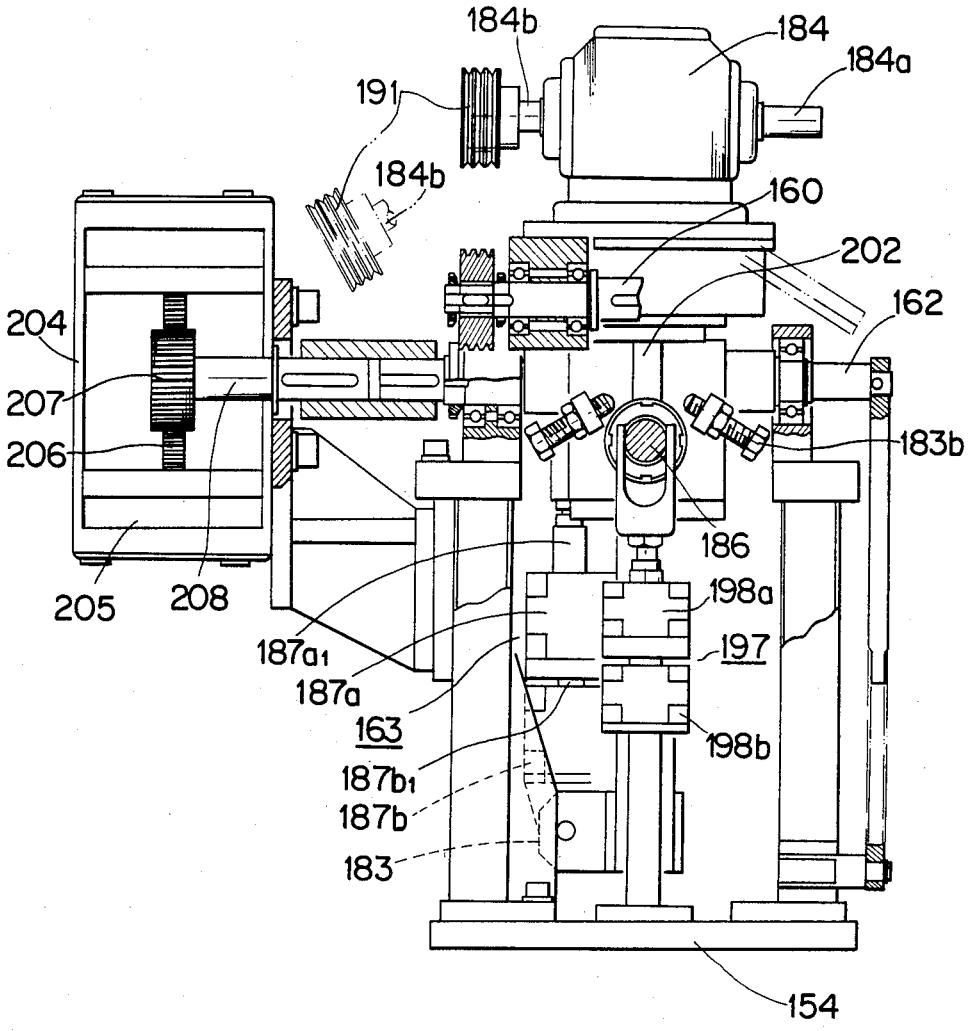
FIG. 25 is a front view partly in section showing ahother embodiment of a shoe making machine according to the present invention.
Figure 26:
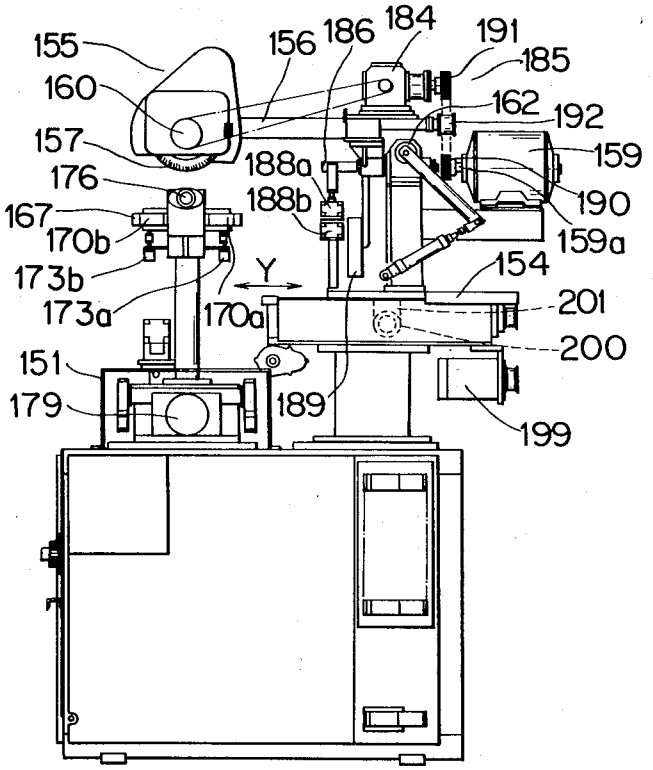
FIG. 26 is likewise a side view showing the whole picture of the shoe making machine.
Figure 27:
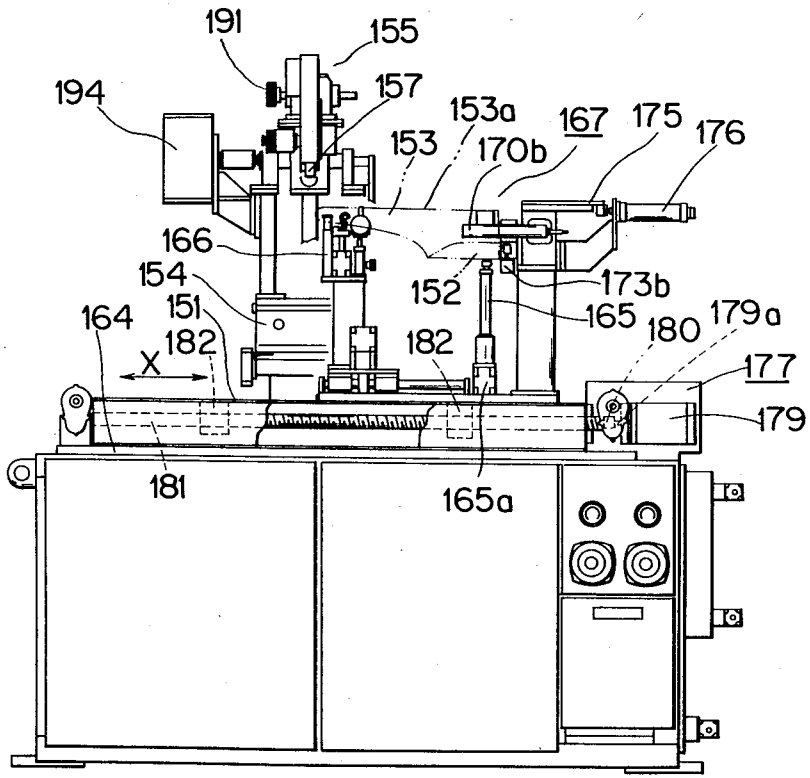
FIG. 27 is likeiwse a front view of the above.
Figure 28:
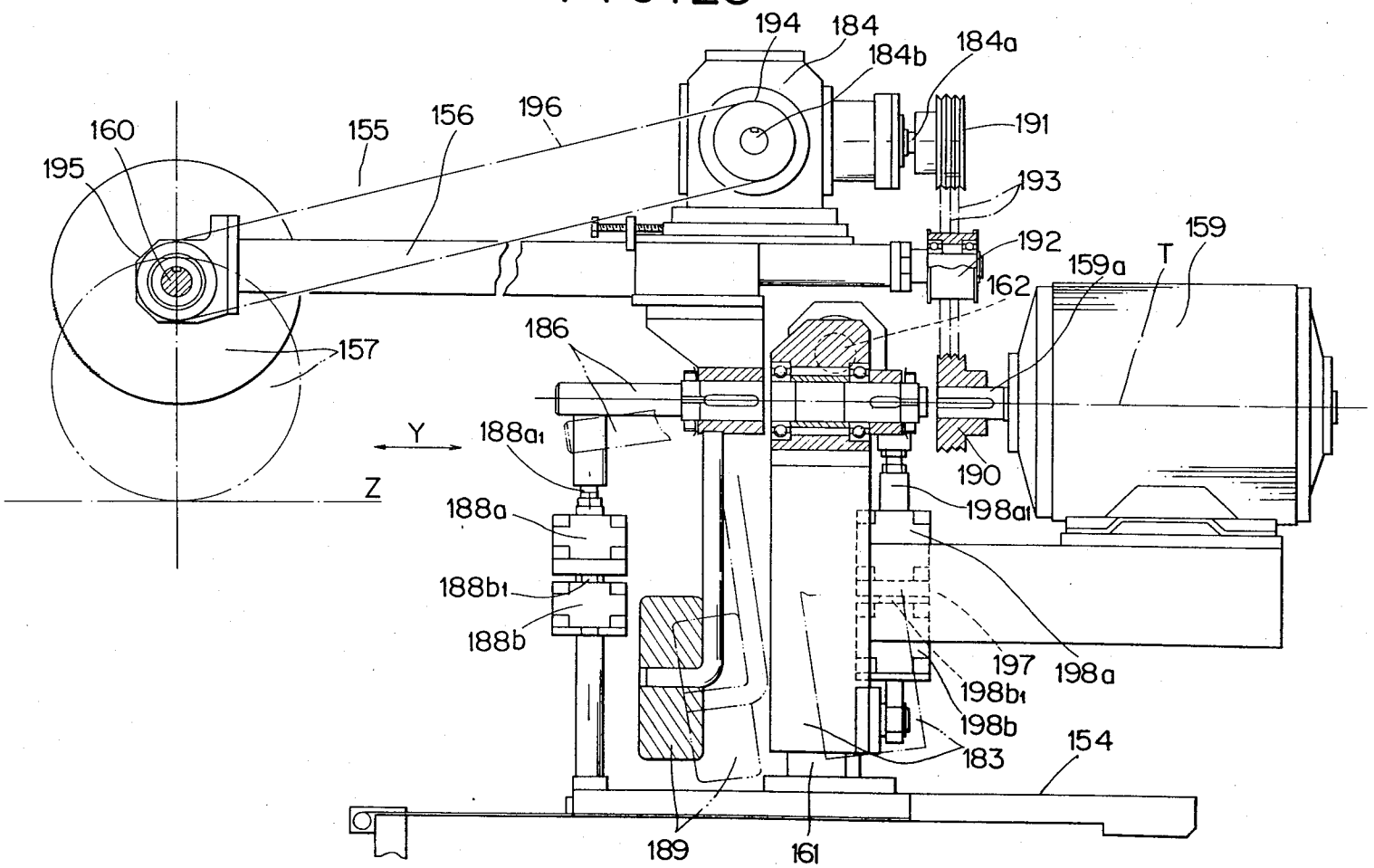
FIG. 28 is likewise a partly vertical sectional view of the above when viewed from the perpendicular direction with respect to the mounting shaft of the brush.

Furthermore, since the twin pneumatic cylinders 188*a*, 188*b* repeat short and quick movements as shown in FIGS. 32*a* through 32*c*, the swing shaft 186 thrusted into the movable frame 183 is pushed up and down starting from the neutral point Z as a standard level. Consequently, the movable frame 183, to which the supporting arm 156 including the brush 157 at its tip portion is fixed, is swung around the supporting shaft 162 from the neutral point Z to control the positional height of the brush 157. As a result, the under-surface outer marginal portion 153*a* of the shoe body 153 is brushed from the tiptoe portion to the heel portion 153*b* at the outside thereof with respect to the central bisector 8 in the axially longitudinal direction as a boarder line. In this case, although, the shoe body 153 has a rising gradient at the side of the arch portion, since the both cylinder rods 187*a*$_1$, 187*b* of the twin pneumatic cylinders 187*a*, 187*b* are extended, the movable frame 183 is pivoted around the pivotal shaft 186 clockwise from the neutral position shown in FIG. 25. As a result, the brush 157 is caused to contact intimately with the under-surface outer marginal portion 153*a* of the shoe body 153 according to the rising gradient at the outside. As a result, the side of the arch portion is ground. Thereafter, since the twin pneumatic cylinders 187*a*, 187*b* are compressed and the both cylinder rods 187*a*$_1$, 187*b*$_1$ are contracted, the movable frame 183 is pivoted counter-clockwise around the swing shaft 186. Consequently, the brush 157 closely contacts for grinding with the gradient from the neutral position E in FIG. 31. Thereafter, since the upper pneumatic cylinder 188*a* is extended, the brush returns to its neutral state and grinds from the tiptoe portion to the heel portion 153*b* at the outside with respect to the central bisector 158 in the axially longitudinal direction as a boarder line on the under-surface outer marginal portion 153*a* of the shoe body 153. When the outside 158*a* of the under-surface outer marginal portion 153*a* is brushed up until the heel portion 153*b*, the motor 159 is revolved adversely. As a result, since the revolving direction of the brush 157 is reversed, the X axis direction movable table 151 is retreated. Consequently, the outside 158*a* of the under-surface outer marginal portion 153*a* having the central bisector 158 in the axially longitudinal direction as the boarder line is brushed or ground from the tiptoe portion toward the heel portion 153*b*. In this case, since the under-surface outer marginal portion 153*a* of the shoe body 153 is formed with a concave surface at the arch portion with the central bisector 158 as a boarder line as shown in FIG. 25, after the neutral state in which only the cylinder rod 187*a*$_1$ of the upper cylinder 187*a* is extended, the both cylinder rods 187*a*$_1$, 187*b*$_1$ of the pneumatic cylinders 187*a*, 187*b* are contracted. Consequently, the movable frame 183 is pivoted around the swing shaft 186 to lower the supporting position than the neutral position. As a result, the brush 157 is also brought to be in its declined state from its neutral state to intimately contact with the falling gradient of the concave surface of the arch portion 153*c*. Thereafter, the both cylinder rods 187*a*$_1$, 187*b*$_1$ of the twin pneumatic cylinders 187*a*, 187*b* are extended to push up the movable frame 183. Consequently, the brush 157 is also caused to be declined from its neutral state to closely contact with the rising gradient of the concave surface of the arch portion 153*c*. Thereafter, the twin pneumatic cylinders 187*a*, 187*b* returns to its neutral state in which the cylinder rod 187*b*$_1$ of the lower pneumatic cylinder 187*b* is contacted, while the upper pneumatic cylinder 187*a* is extended. As a result, the inside 158*b* of the under-surface outer marginal portion 153*a* is ground by the brush 157.

When it is unnecessary to brush or grind a part of the under-surface outer marginal portion 153*a* such as, for example, the heel portion 153*b* of the women's high-heel shoes, since the both two cylinder rods 198*a*$_1$, 198*b*$_1$ of the twin pneumatic cylinders 198*a*, 198*b* are extended to push up the swing shaft 186, the brush 157 is brought to be in a floating state with respect to the shoe body 153. As a result, the heel portion 153*b* is not brushed. In this case, if the time is controlled for pushing up the swing shaft 186, the distance of nonbrushing area of the shoe body 153 can be easily controlled. Furthermore, since the motor 159 for revolving the brush 157 is revolved normally or reversely with the central bisector 158 as the boarder line, the inside 158*b* and the outside 158*a* of the shoe body 153 are brushed or ground from the outside toward the inside. Consequently, the tearing up of the under-surface outer marginal portion 153*a* of the shoe body 153 due to the friction against the brush 157 can be prevented. Furthermore, unfavorable deformation of the brush 157 itself can be avoided.

In this way, when the abrasive operation or grinding operation is finished with respect to the under-surface outer marginal portion 153*a*, the cylinder rods 174$a_1$, 174$b_1$ of the pneumatic cylinders 174*a*, 174*b* are contracted. As a result, the pair of clamping arms 170*a*, 170*b* are opened at the tip portions thereof around the shaft portions 169*a*, 169*b* due to the force of the tension spring 172, thereby opening the clamp for the shoe body 153. After the lifting rod 165 having at its top the setting block 152 with the shoe body 153 putting thereupon are lowered to be in a predetermined height, the pneumatic cylinder 168*a* is decompressed to lower the heel receiving member 168. Furthermore, since the pneumatic cylinder 176 is decompressed, the slide presser 175 is retreated from the oversurface of the clamp mechanism 167 to complete the abrasive operation of the shoe body 153.

Likewise, when the abrasive operation for the right side shoe body 153 is carried out, the slide presser 175 is progressed above the clamp mechanism 167 first in the same manner as described above. Then, the heel portion 153*b* of the shoe body 153 is clamped by the pair of clamping arms 170*a*, 170*b*. At this moment, the differences of the rotary angles of the shaft portions 169*a*, 169*b* supporting the pair of clamping arms 170*a*, 170*b* are encoded by the rotary encoders 173*a*, 173*b*. The thus obtained codes are processed by the computer to distinquish the left side shoe body 153 from the right side shoe body 153 because of the abovementioned differences. Then the lift rod 165 having the setting block 152 on its top is lifted upward and the brush 157 is revolved normally or reversely. Simultaneously, the Y axis movable table 154 carrying the abrasive unit 155 progresses toward or retreats backward with respect to the X axis direction movable table 151 clamping the shoe body 153. As a result, the abrasive operation on the undersurface outer marginal portion 153*a* of the shoe body 153 of the right side is carried out.

In this way, the abrasive operation of the pair of right and left shoe bodies 153, 153 can be carried out.

Although in the above embodiment, the X axis direction movable table 151 clamping the shoe body 153 is moved in the X axis direction to grind the under-surface outer marginal portion 153*a*, the brush 157 as a processing tool may be moved in the axially longitudinal direction to grind the under-surface 153*a*. In the above embodiment, the present invention is applied to an abrasive equipment. However, it can also be applied to other equipments such as a gluing equipment for spreading glue on the under-surface marginal portion of a pair of shoe bodies 503, 503, a primer for jetting an adhesive agent from the nozzle, etc. which are chiefly used to process the bottom member of the shoe after the brushing operation is finished in order to attach the shoe body to the bottom member.

As described in the foregoing, according to the present, invention a processing tool such as a brush, etc. of an abrasive unit is arranged swinable in its width direction, the tool can be normally and intimately contacted following the uneven under-surface outer marginal portion of the shoe body. Consequently, the under-surface outer marginal portion of the shoe body can be uniformly wound without leaving a portion left unbrushed, thus enabling to increase the yield of products and to decrease the production costs.

What is claimed is:

1. A shoe making machine, comprising:

a base;

a slide table movably mounted on said base;

a member fixedly mounted on said slide table for supporting the heel portion of a shoe body to be processed, said supporting member having means for clamping the heel portion of the shoe body;

guide shaft means fixedly mounted on said slide table and disposed in a direction parallel to the direction of movement of said slide table;

a toe portion carrying member having means for accommodating thereon the toe portion of a shoe body to be processed, said toe portion carrying member also having a guide member slidably engaged with said guide shaft means for movement of said toe portion carrying member with respect to said slide table, and thereby with respect to said heel portion supporting member, along said guide shaft means;

means for alternately locking said toe portion carrying member against movement with respect to said slide table or with respect to said base, whereby with said toe portion carrying member being locked against movement with respect to said base, said slide table may be moved on said base and with respect to said toe portion carrying member, thereby changing the distance between said heel portion supporting member and said toe portion carrying member for accommodating shoe bodies of different size, and with said toe portion carrying member being alternately locked against movement with respect to said slide table, said toe portion carrying member and said heel portion supporting member are fixed in relation to one another for supporting a shoe body while said slide table may be moved with respect to said base for processing of the shoe body;

a processing tool head table having a tool for processing the outer marginal portion of the under-surface of a shoe body and having a constant original position to return to slightly away from the toe portion of the shoe body when the shoe body has been set for processing; and, means for simultaneously controlling the longitudinal movement of said slide table carrying a shoe body together with the transverse and vertical movement of said processing tool head table, so that shoe bodies of any size can be promptly processed in accordance with operation commands of a computer having memorized shoe size data.

2. The shoe making machine according to claim 1 wherein:

said alternate locking means comprises a locking plate connected to said toe portion carrying member and having first and second elongated openings therein;

said guide shaft means has a guide shaft disposed in said first opening;

said base includes a base shaft affixed thereto, disposed parallel to said guide shaft means and disposed in said second openings; and said alternate locking means also comprises means for moving said locking plate into a first position, where said locking plate engages and thereby locks said guide shaft at said first opening with said base shaft freely disposed in said second opening, and a second position where said locking plate engages and thereby locks said base shaft at said second opening with said guide shaft freely disposed in said first opening.

3. The shoe making machine according to claim 1 wherein said alternate locking means comprises:

a pin receiving member on said toe portion carrying member;

a stopper pin connected to said base;

means on said base for moving said stopper pin into and out of locking engagement with said pin receiving member;

a locking plate connected to said toe portion carrying member;

means on said toe portion carrying member for moving said locking plate into and out of locking engagement with said guide shaft means; and, means for controlling the movements of said stopper pin and said locking plate for alternate locking engagement of said stopper pin with said pin receiving member of said locking plate with said guide shaft means.

4. The shoe making machine according to claim 1 wherein:

said heel portion clamping means comprises a pair of clamping arms and means for actuating said arms; and, said shoe making machine includes means for detecting right and left shoe shape comprising a detectable element positioned on each of said clamping arms and an electrical sensor directly opposed to each said detectable element fixed in position relative to each respective clamping arm for measuring the relative movement of each clamping arm.

5. The shoe making machine according to claim 4 and including:

means for changing the revolving direction of a processing tool at the central bisector of a shoe body as a border line.

* * * * *